US006833812B2

(12) United States Patent
Diament

(10) Patent No.: US 6,833,812 B2
(45) Date of Patent: Dec. 21, 2004

(54) SYSTEMS AND METHODS FOR PROVIDING OPTIMIZED PATCH ANTENNA EXCITATION FOR MUTUALLY COUPLED PATCHES

(75) Inventor: Paul Diament, New Rochelle, NY (US)

(73) Assignee: The Trustees of Columbia University in the City of New York, New York, NY (US)

( * ) Notice: Subject to any disclaimer, the term of this patent is extended or adjusted under 35 U.S.C. 154(b) by 0 days.

(21) Appl. No.: 10/232,769

(22) Filed: Aug. 30, 2002

(65) Prior Publication Data

US 2003/0090422 A1 May 15, 2003

Related U.S. Application Data

(60) Provisional application No. 60/316,628, filed on Aug. 31, 2001, and provisional application No. 60/343,497, filed on Dec. 21, 2001.

(51) Int. Cl.[7] ..... H01Q 3/26; H01Q 3/00

(52) U.S. Cl. ..... 342/372; 342/377

(58) Field of Search ..... 342/368, 371–372, 342/377; 343/700 MS; 702/190, 196–197

(56) References Cited

U.S. PATENT DOCUMENTS

| | | | | | |
|---|---|---|---|---|---|
| 3,713,162 | A | | 1/1973 | Munson et al. | |
| 3,858,221 | A | * | 12/1974 | Harrison et al. | 342/371 |
| 4,336,543 | A | * | 6/1982 | Ganz et al. | 342/371 |
| 4,755,829 | A | * | 7/1988 | Dinger et al. | 342/372 |
| 5,867,123 | A | * | 2/1999 | Geyh et al. | 342/372 |
| RE36,506 | E | | 1/2000 | Dempsey et al. | |
| 6,057,802 | A | | 5/2000 | Nealy et al. | |
| 6,061,027 | A | | 5/2000 | Legay et al. | |
| 6,225,946 | B1 | * | 5/2001 | Kreutel et al. | 342/368 |
| 6,492,942 | B1 | * | 12/2002 | Kezys | 342/372 |

OTHER PUBLICATIONS

H. Moheb et al., Effect of radome on mutual coupling of finite array of circular waveguides and cavities, Proceedings of Symposium on Antenna Technology and Applied Electromagnetics, p. 757–760, Aug. 1996.*

H.M. Aumann et al., Phased array antenna calibration and pattern prediction using mutual coupling measurements, IEEE Transactions on Antennas and Propagation, vol. 37(7), p. 844–850, Jul. 1989.*

J. Huang et al., Microstrip Yagi array antenna for mobile satellite vehicle application, IEEE Transactions on Antennas and Propagation, vol. 39(7), p. 1024–1030, Jul. 1991.*

W.L. Stutzman and G.A. Thiele, *Antenna Theory and Design*, 2nd ed., J. Wiley, 1998 pp. 210–219.

A.G. Derneryd, "*A Theoretical investigation of the rectangular microstrip antenna element*," IEEE Trans. Antennas Propagat., vol. 26, Jul. 1978 pp. 532–535.

N.P. Kernweis and J.F. McIlvenna, "*Liquid crystal diagnostic techniques—an antenna design aid*," Microwave Journal, vol. 20, pp. 47–58, Oct. 1977.

(List continued on next page.)

*Primary Examiner*—Bernarr E. Gregory
*Assistant Examiner*—F H Mull
(74) *Attorney, Agent, or Firm*—Proskauer Rose LLP

(57) ABSTRACT

An antenna array (e.g., microstrip patch antenna) operates in a manner that exploits the particular susceptibility of the mutual coupling effects between radiating elements in the array. Various differential-mode excitation schemes are provided for determining optimal differential-mode voltages or optimal differential-mode currents that are applied to the radiating elements (e.g., microstrip patches) to thereby achieve certain desirable radiation characteristics including, for example, aiming a radiated beam in a prescribed direction, steering the beam, shaping the radiated beam, and/or optimizing the gain of the antenna in a specified direction.

59 Claims, 9 Drawing Sheets

OTHER PUBLICATIONS

R.E. Munson, *Conformal microstrip antennas and micrstrip phased arrays*, IEEE Trans. Antennas Propagat., vol. 22, pp. 74–78, Jan. 1974.

Y.T. Lo, D. Solomon, and W.F. Richards, "*Theory and experiment on microstrip antennas*," IEEE Trans. Antennas Propagat., vol. 27, pp 137–145, Mar. 1979.

W.F. Richards, Y.T. Lo, and D.D. Harrison, "*An improved theory for microstrip antennas and applications*, " IEEE Trans. Antennas Propagat., vol. 29, pp. 38–46, Jan. 1981.

K.R. Carver and J.W. Mink, "*Microstrip antenna technology*, " IEEE Trans. Antennas Propagat., vol. 29, pp 2–24, Jan. 1981.

D. Thouroude, M. Himdi, and J.P. Daniel, "*CAD–oriented cavity model for rectangular patches*, " Elect. Lett., vol. 26, pp. 842–844, Jun. 1990.

F. Assadourian and E. Rimai, "*Simplified theory of microstrip transmission systems*, " Proc. IRE, vol. 40, pp. 1651–1657, Dec. 1952.

E.D. Newman and P. Tulyathan, "*Analysis of microstrip antennas using moment methods*, "IEEE Trans. Antennas Propagat., vol. 29, pp. 47–53, Jan. 1981.

A.A. Kishk and L. Shafai, "*The effect of various parameters of circular microstrip antennas on their radiation efficiency and the mode excitation*," IEEE Trans. Antenna Propagat., vol. 34, pp. 969–976, Aug. 1986.

J.R. Mosig and F.E. Gardiol, "*General integral equation formulation for mictrostrip antennas and scatterers*," Proc. IRE, vol. 132, pt. H, pp. 424–432, Dec. 1955.

D.M. Pozar, "*Finite phased arrays of rectangular microstrip patches*," IEEE Trnas. Antennas Propagat., vol. 34, pp. 658–665, May 1986.

A.K. Skrivervik and J.R. Mosig, "*Finite phased arrays of microstrip patch antennas: the infinite array approach*," IEEE Trans. Antennas Propagat., vol. 40, pp. 579–582, May 1992.

K.F. Lee, W. Chen 1997 *Advances in Microchip and Printed Antennas* pp. 128–133.

J.P. Daniel, A. Capelle, J.R. Forrest, *Microchip Patch Arrays For Satellite Communications* ESA/COST204 Phazed–Array Antenna Workshop, Jun. 13, 1983, pp. 9–14.

C.A. Balanis, *Antenna Theory*, $2^{nd}$ Edition, Chapter 14, J. Willey & Sons, NY 1997.

J.D. Kraus, *Antennas*, $2^{nd}$ Edition, pp. 745–749, McGraw–Hill Book Co., NY 1988.

D.M. Pozar & D.H. Schaubert *Microchip Antennas*, Chapters 1, 2, 5, 6, 7, IEEE Press, NY 1995.

D.M. Pozar, *Microwave Engineering*, pp. 267–274 and 401–406, Addison–Wesley Publishing Company 1990.

R.E. Collin, *Field Theory of Guided Waves*, Chapter 7, McGraw–Hill Book Co., 1960.

P. Diament, *Dynamic Electromagnetics*, Prentice Hall, NJ 2000, pp. 182–185.

William F. Richards, *Microchip Antennas, Antenna Handbook*, vol. II, 1993, pp. 10–1–10–74.

Robert E. Munson, *Microstrip Antennas, Antenna Engineering Handbook*, Third Edition, 1993 pp. 7–1–7–30.

Milton Abramowitz and Irene A. Stegun, *Gamma Function and Related Functions, Handbook of Mathematical Functions With Formulas, Graphs, and Mathematical Tables*, Tenth Printing, Chapter 6, pp. 255–266, Dec. 1972.

Milton Abramowitz and Irene A. Stegun, *Bessel Functions of Integer Order, Handbook of Mathematical Functions With Formulas, Graphs, and Mathematical Tables*, Tenth Printing, Chapter 9, pp. 358–389, Dec. 1972.

* cited by examiner

SYSTEMS AND METHODS FOR PROVIDING OPTIMIZED PATCH ANTENNA EXCITATION FOR MUTUALLY COUPLED PATCHES

CROSS-REFERENCE TO RELATED APPLICATIONS

This application claims priority to U.S. Provisional Application Ser. No. 60/316,628, filed on Aug. 31, 2001, and to U.S. Provisional Application Ser. No. 60/343,497, filed Dec. 21, 2001, which provisional applications are fully incorporated herein by reference.

TECHNICAL FIELD

The present invention generally relates to antennas comprising an array of radiating elements, and methods for exciting the array elements in a manner that exploits the mutual coupling effects between the elements. More particularly, the present invention relates to systems and methods for providing differential-mode excitation of microstrip patch antennas and monolithic microwave integrated circuit (MMIC) antenna arrays, wherein radiation is generated and emitted from substantially the entire top surfaces of the patches, rather than merely from their edges, thereby enhancing the radiation and improving efficiency. Differential-mode excitation schemes according to the invention may be used for, e.g., electronically steering a radiating beam, shaping a radiating beam, and optimizing the gain of the antenna array in a specified direction.

BACKGROUND

Microstrip antennas (or patch antennas) provide low-profile antenna configurations for applications that require small size and weight. Such antennas are also desirable when there is a need to conform to the shape of the supporting structure, both planar and nonplanar, such as for an aircraft's aerodynamic profile. These antennas are simple and inexpensive to manufacture using printed-circuit technology, wherein metallic patches (or patch radiators) are typically photoetched onto a dielectric substrate.

The conventional wisdom regarding microwave patch antennas is that the patches radiate from their edges. More specifically, when the elements of a patch antenna array are excited in common mode (i.e., with equal voltages), the fields that are generated are primarily confined to the dielectric space under each surface element, except for the fringing fields at the edges of the elements. The commonly held view of the mechanism of radiation by patch antennas is that it is the fringing fields at the edges that radiate into the air. Indeed, various models and theoretical analyses have been developed to explain this radiation mechanism, such as the slot radiation model (see, e.g., R. E. Munson, "*Conformal microstrip antennas and microstrip phase arrays*," IEEE Trans. Antennas Propagat., vol. 22, pp 74–78. January, 1974) or the cavity model (see, e.g., Thouroude et al, "CAD-oriented cavity model for rectangular patches," Elect. Lett., vol. 26. pp. 842–844, June 1990). Both the slot and cavity models assume radiation comes only from the edges. Other models known to those skilled in the art, including, for example, conformal mapping, moment methods, and Green's functions, have been developed, which implicitly include fields that are not at the edges. However, these methods offer limited insight into the radiation mechanism.

FIG. 1 illustrates a typical patch antenna array 10 that comprises small conducting surfaces 18 separated from a large parallel ground plane 14 by a dielectric substrate 16.

When the same real or complex (real and imaginary or amplitude and phase) RF voltage Vo is applied to each surface 18, an electric field pattern 15 is set up in the dielectric, essentially acting as a capacitor but with a relatively weak fringing fields 12 at the edges (for clarity, fields 12 are not shown continuing into the substrate). The roughly uniform fields 15 under the surface are fairly well shielded from the outside space, but the fringing field at the edges can act as radiating elements. To take advantage of the edge radiators, it may be necessary to excite the capacitive structure in a higher-order mode and using off-center feeds, to avoid mutual cancellation of the radiation from different edges.

Microstrip patch antennas commonly exhibit disadvantageous operational characteristics such as low efficiency, low power, narrow bandwidth, and poor scanning performance. Further, patch antennas are typically excited in an asymmetric manner to generate high-order modes of the dielectric substrate, which adds to the complexity of the electrical feed circuitry.

A natural phenomenon referred to as "mutual coupling" occurs when the patches of an antenna array are subjected to differential-mode excitation (e.g., different voltage amplitudes and phases). In particular, when the applied voltages at two or more patches are different, fields will be set up not only within the substrate directly under each patch, but also in the air space above the patches, emanating from one patch and ending on another.

Conventionally, designers of patch antennas ignore or attempt to reduce the effects of mutual coupling. However, it would be highly beneficial to develop a framework for differential-mode excitation of an antenna array that would exploit the mutual coupling between patches to provide efficient radiation from the exposed top surfaces of antenna patches to, thereby, overcome the above noted deficiencies and disadvantages of conventional patch antenna schemes.

SUMMARY OF THE INVENTION

The present invention is generally directed to antennas comprising an array of radiating elements, and methods for exciting the array elements in a manner that exploits the mutual coupling effects between the elements. More particularly, the present invention relates to systems and methods for providing differential-mode excitation of microstrip patch antennas and monolithic microwave integrated circuit (MMIC) antenna arrays. It is an objective of the present invention to devise and prescribe differential-mode excitation methods, which impose different radio frequency (RF) voltages or currents at the different array elements (e.g., patches), to thereby generate and emit radiation from substantially the entire top surfaces of the patches, rather than merely from their edges, thereby enhancing the radiation and improving efficiency. Indeed, differential-mode excitation methods according to the invention are employed to operate an antenna array in a manner that exploits the particular susceptibility of array elements to mutual coupling effects such that the array radiates copiously from the top surfaces of the patches instead of merely from their edges.

Various methods according to the invention are provided for generating optimal differential-mode voltages or currents that are applied to elements of an array to thereby achieve particular radiation characteristics. For example, differential-mode excitation schemes enable electronic steering of a radiating beam, shaping of a radiating beam, and optimizing the gain of the antenna array in a specified direction.

In one aspect of the invention, an antenna system comprises an array of radiating elements, voltage generating system (e.g., computer-based systems) for generating differential-mode voltages or currents for exciting the radiating elements, and a device for feeding the differential-mode voltages or currents to the radiating elements, wherein when the differential-mode voltages or currents are applied to the radiating elements, a radiation beam is generated from mutual coupling between the radiating elements in the array.

In another aspect of the invention, a computer is employed to generate a stream of complex numbers (which represent the excitation voltages or currents) that are determined using a radiation model that provides an efficient, yet accurate, model for determining a radiation pattern emitted from an antenna array operating in differential mode. Optimal excitation voltages or currents can be determined to achieve one of possible objectives, such as aiming or steering a radiating beam or optimizing the gain.

In another aspect, various devices and methods are provided for feeding the excitation RF voltages or currents addressed to each radiating element individually, with amplitudes and phases prescribed by the determined complex numbers. Steering of the radiated beam is accomplished by repeatedly issuing new lists of complex numbers to be applied as voltages or currents to the patches.

These and other aspects, objects, features and advantages of the present invention will be described or become apparent from the following detailed description of preferred embodiments, which is to be read in connection with the accompanying drawings.

DETAILED DESCRIPTION OF PREFERRED EMBODIMENTS

The following detailed description of preferred embodiments is divided into the following sections for ease of reference. Section I provides a general overview of features and advantages of an antenna array that operates under differential-mode excitation according to the invention. Section II provides a detailed discussion of preferred and exemplary embodiments of systems and methods for providing differential-mode excitation of an antenna array according to the invention. Section III discusses various embodiments for feeding voltages or currents to an antenna array for operating the antenna array in differential-mode. Section IV provides a detailed discussion of a method for determining the radiation from an array of patch antennas in differential-mode operation, wherein a model is developed to determine the field structure in the air space above a patch antenna array when operating in differential-mode.

I. General Overview

The present invention exploits the discovery that an antenna array of two or more individually excitable patches can function through the mutual coupling phenomenon in a manner that permits the patches to radiate from their outer surfaces instead of merely from their edges, when the excitation of the patches is in suitable differential-mode, with at least one voltage or current having different amplitudes and phases. More specifically, it has been determined that when different voltages or currents are applied at two or more patches in the antenna array (i.e., using differential-mode excitation), fields will exist not only within the substrate directly under each patch but also in the air space above the patches, emanating from one patch and ending on another.

Figure 1:
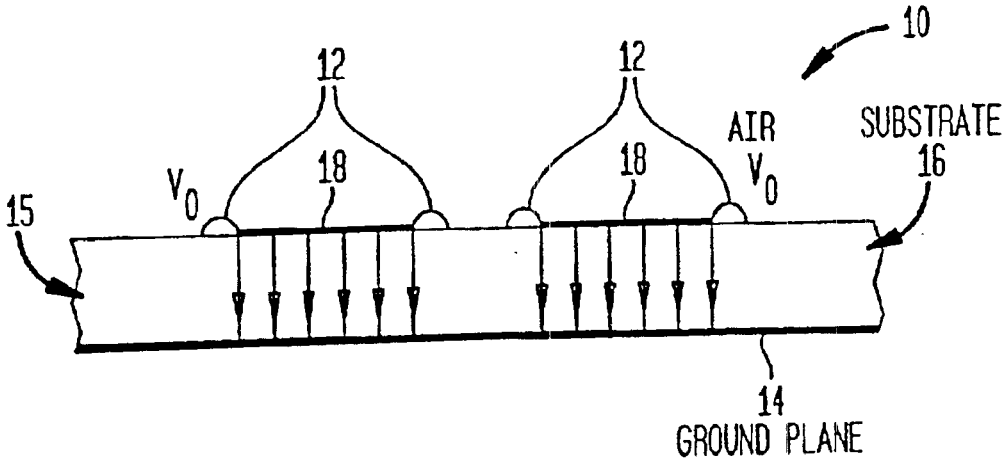
FIG. 1 (PRIOR ART)
FIG. 1 is an exemplary diagram illustrating a field configuration for two patches operating in common-mode.
Figure 2:
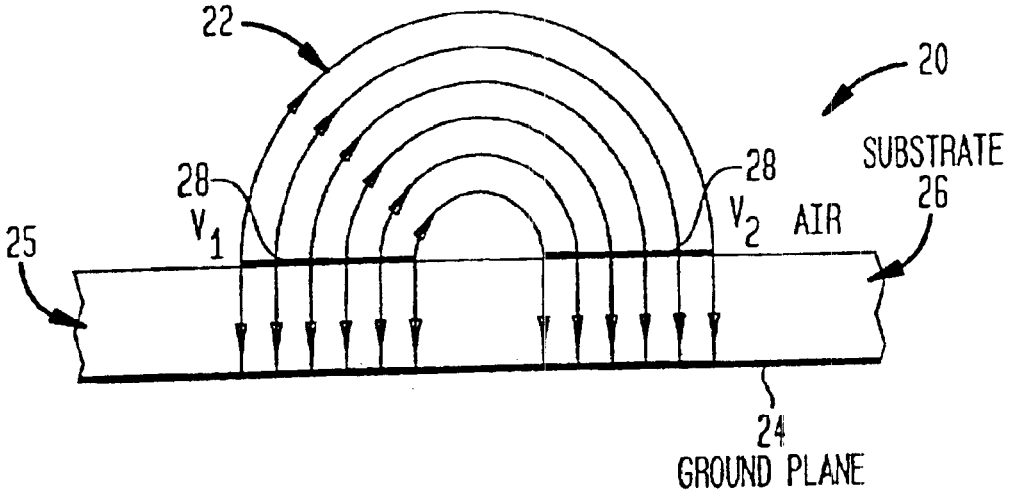
FIG. 2 is an exemplary diagram illustrating a field pattern that is generated by an antenna array comprising two patches operating in differential-mode according to an embodiment of the invention.

FIG. 2 is an exemplary diagram illustrating field patterns that are generated by a patch antenna array 20 when operating in differential-mode according to the invention. The patch antenna array 20 comprises two small conducting surfaces 28, separated from a large parallel ground plane 24 by a dielectric substrate 26. As shown, a coupling field pattern 22 exists in the air space above the patches. The coupling fields 22 in air space are unshielded. The coupling fields 22 radiate copiously and occupy regions of space that correspond to the entire area of each patch 28, not just the edges of the patch. Further, a field pattern 25 exists within the substrate 26 directly under each patch 28. It is to be understood that weak fringing fields also exist at the edges of the patches 28 and in the substrate 26, but an illustration of such weak fields is omitted from FIG. 2 to promote clarity.

Figure 3:
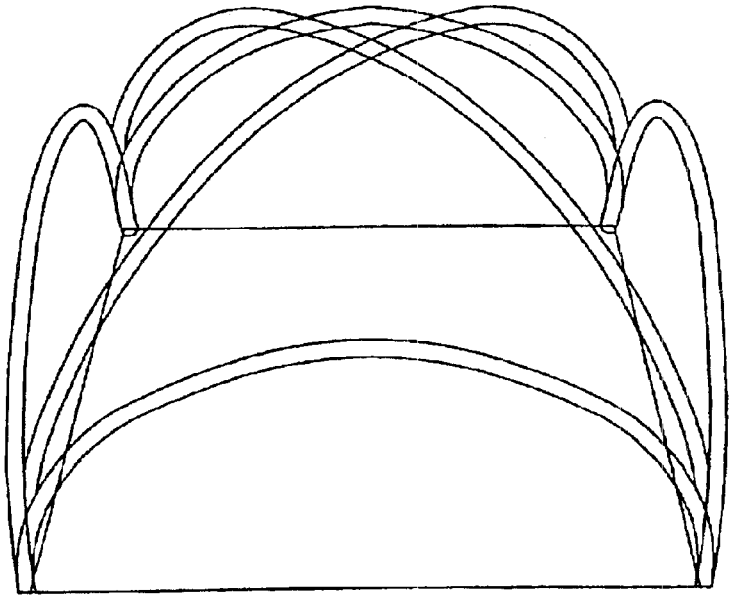
FIG. 3 is an exemplary perspective view of radiating arcs that are generated by a square array of four patches using a differential-mode excitation method according to an embodiment of the invention.

The field patterns 22, 25 are generated when the two patches 28 are excited by, e.g., two different RF real or complex voltages $V_1$ and $V_2$. The coupling fields 22 require a voltage difference between patches and, in accordance with the invention, the patches are effective as radiators when the array is operated in differential-mode. The coupling fields 22 in the air space above the patches oscillate in time and therefore constitute displacements current that radiate outwards into space. In general, the coupling fields 22 arc from one patch to the other, necessarily beginning and ending perpendicular to the conducting patch surfaces. In FIG. 2, the field lines 22 that provide mutual coupling of the two patches 28 in the air space are shown as being semicircular. It is to be understood that the semicircular shape of the field pattern 22 is an approximation that is used to facilitate calculations of the field pattern. Indeed, the actual field lines follow some other arc through the air from one patch to the other, while maintaining perpendicularity at the surface of each patch. By way of example, FIG. 3 is an exemplary perspective view of six radiating arcs that are generated by a square array of four patches using a differential-mode excitation method according to an embodiment of the invention.

An analysis of the radiation from the semicircular field lines that couple pairs of patches demonstrates that the patches radiate in a manner that differs significantly from the manner in which arrays of uncoupled elements radiate. Indeed, it is to be appreciated that the present invention makes direct and deliberate use of the mutual coupling between patches excited in differential-mode. Such mutual coupling represents the major radiation mechanism, not merely a small correction to the edge radiation of conventional designs. A detailed analysis for determining a radiation pattern emitted by a patch antenna array operating in differential-mode operation is provided below in Section IV. In general, for purposes of analysis, a model of the radiation pattern assumes that the coupling field comprises semicircular arcs and that the field strength along these arcs can be replaced by their average value. The Fourier transform of these assumed fields gives the radiation pattern in any direction. A radiation model according to the invention allows a radiation pattern to be determined efficiently, by reducing the calculation to the solution of a simple, stable recurrence relation.

In general, a patch antenna array using a differential-mode excitation scheme according to the invention provides many features and advantages that can not be obtained with conventional designs using common-mode excitation. For example, broadside radiation (vertically away from the substrate) can be achieved with differential-mode excitation of the patch elements but can not be achieved with common-mode excitation. Further, radiation of the array in a specified direction using differential-mode excitation, does not require the usual progressive phasing of the patches as with common-mode excitation.

Further, several rules that must be applied when designing conventional array antenna do not apply to a differential-mode excitation scheme according to the invention For instance, calculations based on the well-known "space factor" of phased array antennas for uncoupled, isotropic radiators are generally not applicable in the present invention. Conventionally, a designer of a patch antenna would first design the "space factor" (the appropriate size, shape, and spacing of the array) to achieve the desired gain and shape of the beam. With respect to beam shape, however, it is to be appreciated that the shape of the patches is not an important consideration in the inventive design using differential-mode excitation. The primary consideration given to the size of the patches of the antenna array operating in differential-mode is for the overall power of the beam, but not the shape of the beam. Rather, as explained in detail below, it is the spacing between the patches that controls the radiation properties.

Other features of an antenna array operating in differential-mode is that radiation intensity varies based on, e.g., the square of the area of all the patches in the array, which is to be contrasted with conventional schemes where the radiation intensity varies based on the area of each patch in the array. Moreover, it is to be appreciated that an antenna array operating in differential-mode according to the invention need not be square and need not be planar. Further, the patches need not even be regularly spaced.

Furthermore, an array of M mutually coupled patches that is excited in differential-mode according to the present invention effectively constitutes a collection of $M(M-1)/2$ radiators, not merely M isolated radiators. For example, an array of 64 patches (e.g., in an 8×8 array) effectively comprises $64\times63/2=2{,}016$ patch radiators. Similarly, as depicted in FIG. 3, a square array of 4 patches (a 2×2 array) comprises $4\times3/2=6$ patch radiators. FIG. 3 illustrates six field lines that couple the 4 patches that are situated at the corners of the array square. Each of these six arcs contributes to the radiation from the array of four patches. Other advantages and features of the invention will be evident to those of ordinary skill in the art based on the teachings herein.

II. Systems and Methods for Differential-Mode Excitation of Antenna Array

The present invention provides novel systems and methods for utilizing, designing, and optimizing antenna arrays such as microstrip patch antenna arrays. For differential-mode excitation of an antenna array, various methods described herein provide determination of optimal excitation voltages or currents that are applied to the array to optimize the gain, adjust the shape, and/or steer the radiation beam emitted from a patch antenna array. Further, methods are provided for determining optimal spacing between patches in an array.

It is to be understood that the systems and methods described herein in accordance with the present invention may be implemented in various forms of hardware, software, firmware, special purpose processors, or a combination thereof. Preferably, the methods described herein for providing differential-mode excitation according to the invention are preferably implemented in software as an application comprising program instructions that are tangibly embodied on one or more program storage devices (e.g., magnetic floppy disk, RAM, CD ROM, ROM and Flash memory), and that are executable by any device or machine comprising suitable architecture.

It is to be further understood that since constituent system modules and method steps depicted in the accompanying Figures are preferably implemented in software, the actual connections between the system components (or the flow of the process steps) may differ depending upon the manner in which the present invention is programmed. Given the teachings herein, one of ordinary skill in the related art will be able to contemplate these and similar implementations or configurations of the present invention.

Figure 6:
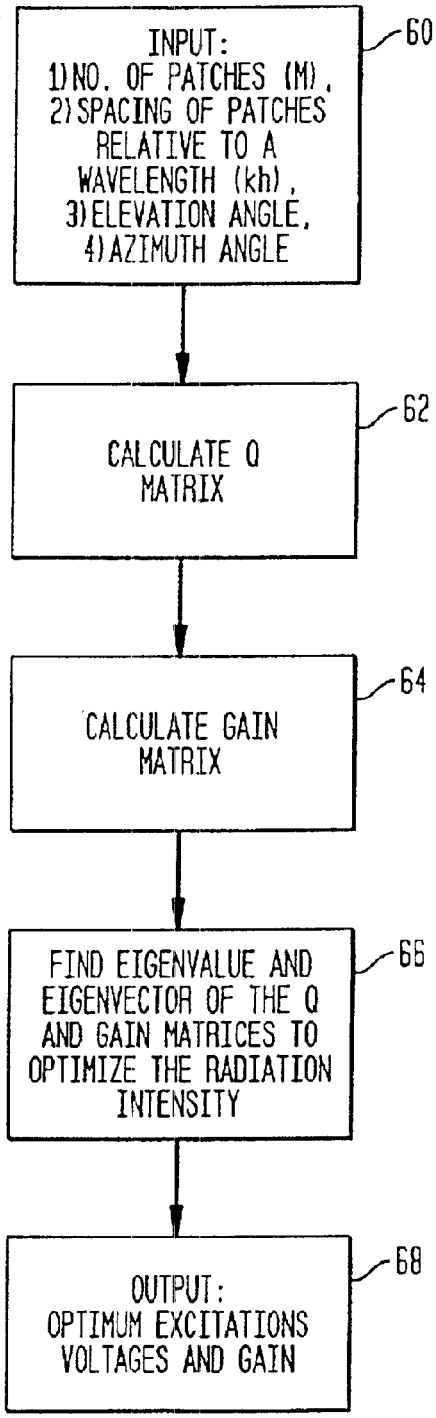
FIG. 6 is a flowchart illustrating a method according to an embodiment of the invention for determining differential-mode voltages to optimize the antenna gain in a selected direction.
Figure 7:
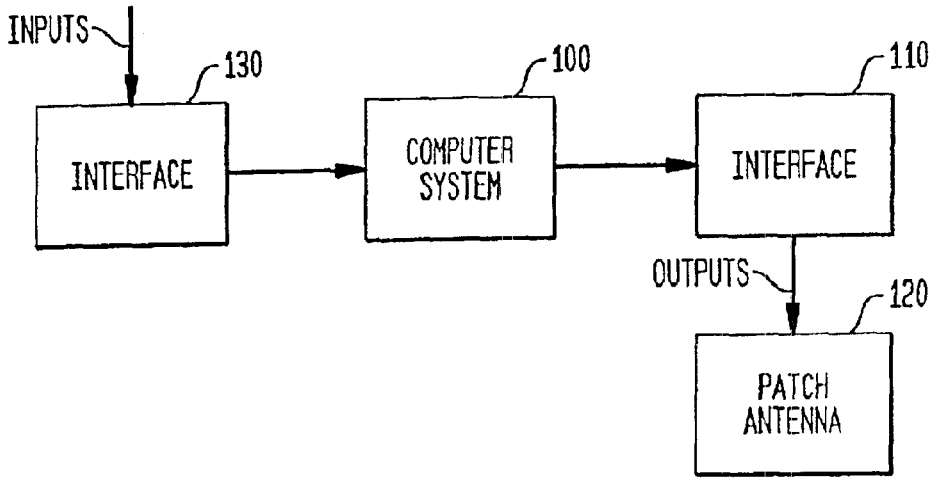
FIG. 7 is a schematic diagram of a system according to one embodiment of the invention for providing differential-mode excitation of an antenna array.

FIG. 7 is a schematic diagram of a system according to one embodiment of the invention for providing differential-mode excitation of an antenna array. The system comprises a computer system 100 that implements the processes described below with reference to FIGS. 4–6. Generally, computer system 100 will have suitable memory (e.g., a local hard drive, RAM, etc) that stores one or more applications comprising program instructions that are processed to implement the steps of FIGS. 4–6. These applications may be written in any desired programming language, such as C++ or Java. In addition, the applications may be local to the computer system 100 or distributed over one or more remote servers across a communications network (e.g., the Internet, LAN (local area network), WAN (wide area network)).

The computer system 100 receives inputs, from an external source (such as a satellite beacon) via an interface 130 (such as an A/D (analog-to-digital) interface). In addition, computer system 100 may receive inputs via a keyboard, a mouse, a scanner, a memory store, and the like (not shown). The outputs, generated by computer system 100, are preferably transmitted to a patch antenna array 120 via an interface 110 (such as a D/A (digital-to-analog) interface). Interface 110 may be configured to convert complex numbers to their respective voltages or currents. It is to be understood that although the interfaces 110 and 130 are shown as being separate elements, such interfaces or related functionality can be included in the host computer system 100. In addition, the outputs may be output to a display, printer, a memory store, and the like. Examples of such input and output parameters will be described with reference to FIGS. 4–6.

In one embodiment of the invention, the computer system 100 determines differential-mode voltages to be applied to the patch antenna array 120 and generates a stream of complex numbers (representing the voltages) that are used to excite the array 120 so as to achieve certain desirable radiation characteristics including, for example, aiming a radiated beam in a prescribed direction, steering the beam, shaping it, and/or optimizing the antenna's gain in a specified direction. Steering of the radiated beam is accomplished by repeatedly issuing new lists of complex numbers to be applied as voltages to the patches. In another embodiment, the computer system 100 determines differential-mode currents to be applied to the patch antenna array 120 and generates a stream of complex numbers representing such currents.

Appropriate electronic circuitry is employed to deliver the RF voltages (or currents) addressed to each patch individually, with amplitudes and phases prescribed by the calculated complex numbers. Various methods according to preferred embodiments of the invention for feeding voltages $V_1, V_2, \ldots V_n$ (or currents $I_1, I_2, \ldots I_n$) (which are generated by computer system 100 and/or interface 110) to each patch in the antenna array 120 are discussed, for example, with reference to FIGS. 8–11, although it is to be understood that other suitable methods for feeding the voltages or currents to the patches may be implemented as well. Such feeding circuitry may be, e.g., integrated into a printed circuit that incorporates the antenna array (but note that the antenna array may be of types other than printed circuit antennas). Since common-mode excitation is generally not used, the electrical feeds, which supply the voltages or currents to the patches, need not be off-center.

Figure 4:
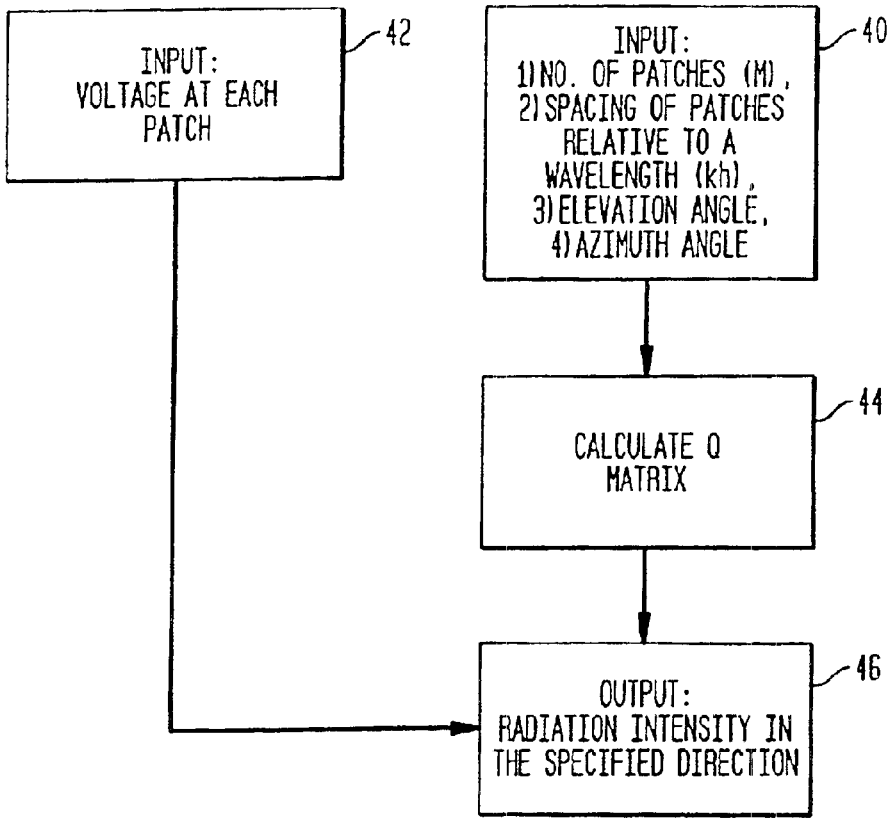
FIG. 4 is a flow chart illustrating a method according to an embodiment of the invention for determining radiation intensity for a given set of differential-mode voltages.
Figure 5:
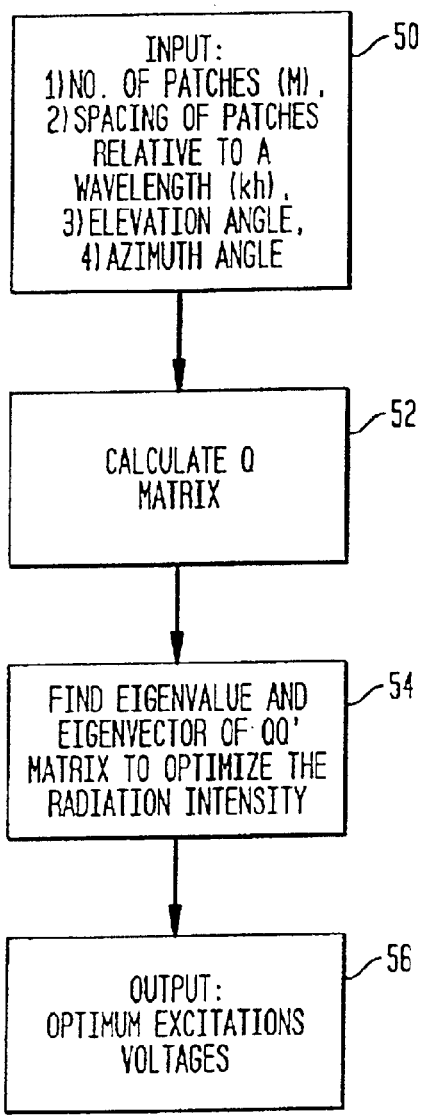
FIG. 5 is a flowchart illustrating a method according to an embodiment of the invention for determining differential-mode voltages to optimize radiation in a selected direction.

In general, FIGS. 4–6 are flow diagrams illustrating various methods for providing differential-mode operation of an antenna array according to the invention. It is to be appreciated that optimization of the excitations of the array elements in the present invention is achieved by expressing the radiation intensity as a ratio of quadratic forms in the unknown excitation voltages. As will be described in detail with reference to FIGS. 4–6, methods of linear algebra are applied to extract an optimal eigenvalue and associated eigenvectors of the matrix at the core of the quadratic form. Similarly, optimization of the gain of the array is accomplished by expressing the gain as a ratio of two quadratic forms, where the gain is calculated based on the optimal so-called "generalized" eigenvalue. Further, as will be described below, the so-called generalized eigenvectors correlate to, e.g., the optimum voltage assignments.

Referring now to FIG. 4, a flow chart illustrates a method of determining radiation intensity for a given set of differential voltages according to an embodiment of the present invention. More specifically, FIG. 4 is a flowchart illustrating a method of determining radiation intensity $$\frac{dP}{d\Omega}$$

for selected or arbitrary voltages in a selected direction in accordance with the present invention. Initially, a plurality of parameters are input to the system (step 40). For purposes of illustration, it is assumed that we are determining the radiation intensity of a 3×2 patch array antenna and that the input parameters (in Step 40) comprise the following: the number of patch radiators M=6 (i.e., 3×2), the separation distance between each patch h=0.5 cm, the elevation angle θ=30 degrees, and the azimuth angle ϕ=15 degrees. These variables may be inputted, e.g., into computer system 100 of FIG. 7 for processing.

The patch antenna, and radiation beam that emits therefrom, may be graphically illustrated on an x,y,z-axis plot, where the x and y-axis are on the horizontal plane and the z-axis is vertical, perpendicular to the horizontal x,y-axis plane. For a planar patch antenna, the patches will be on the horizontal x,y-axis plane. The azimuth angle ϕ represents the angle around the vertical z-axis from the horizontal x-axis, and the elevation angle θ represents the angle from the vertical z-axis. The term $\hat{n}$ denotes a unit vector that points in the direction provided by the azimuth angle ϕ and the elevation angle θ. Specifically, $\hat{n}$ may be broken into its x,y,z-axis components, where the x component equals sin θ cos ϕ, the y component equals sin θ sin ϕ, and the z component equals cos θ. It should be noted that the elevation angle θ is different than angle θ representing the semicircle arc in equations (5)–(9) of Section IV below.

Further, to input the spacing of patches kh (i.e., the spacing relative to wavelength), the variable k (vacuum wave number) is determined by computing $$k = \frac{2\pi}{\lambda},$$

where λ is the free-space wavelength. Therefore, if we assume that λ=1.0 cm, then $$kh = \frac{2\pi}{\lambda}(h) = 3.1.$$

After the input parameters are provided, a Q matrix is determined (step 44), wherein $Q=Q(\hat{n})$ comprises an M×2 matrix that depends on the direction of the observation point and on the geometry of the patch array, but not on the voltage excitations. As discussed in detail below in section IV, the Q matrix is preferably determined using equations (3)–(23), and processed in, e.g., computer system 100 of FIG. 7. In particular, to determine the Q matrix, a matrix W is first determined using equations (3)–(23). Once matrix W is determined, the Q matrix may be determined using the equation W·H, where H comprises a 3×2 orthonormal matrix representing the null space of n̂. As described in section IV, matrices W and H may be represented by respective matrix expressions, such that conventional linear algebra methods may be used to calculate a 6×2 Q matrix. It should be noted that matrix Q (and its hermitian conjugate Q', i.e., the complex conjugate transpose Q') is different than charges Q1 and Q2 of equations (1)–(2) in Section IV. In the exemplary embodiment using the above input parameters in step 40, the Q matrix is shown in Table 1 below:

TABLE 1

| | |
|---|---|
| 0.6050 + 0.1215i | 0.1508 − 0.2720i |
| 0.0028 + 0.7324i | 0.5377 − 0.0412i |
| −0.6866 − 0.7969i | 0.2865 + 0.4250i |
| 0.5882 + 0.2185i | −0.0610 + 0.4104i |
| −0.1178 + 0.6594i | −0.6410 + 0.1042i |
| −0.3915 − 0.9349i | −0.2730 − 0.6264i |

As shown, each of the twelve values is a complex number, having real and imaginary (i) components. The hermitian conjugate Q' matrix may now be calculated as a 2×6 matrix of complex numbers.

Now let us assume that arbitrary input voltages (selected or arbitrary) are inputted into computer system 100 (step 42). In the exemplary embodiment where there are 6 patches, there will be 6 voltages. For example, the voltages may be V=1, 2, −1, 3, −2, 2. Note that some of the voltages may be equal in value (as in this example). Further, although these voltages as shown are real number values, they may be in terms of complex number values as well.

Next, the radiation intensity in the specified direction is determined and output from computer system 100 to patch antenna 120 via interface 110 (step 46). The radiation intensity is preferably determined as $$\frac{dP}{d\Omega} = \frac{M^2A^2}{\lambda^4}\frac{|V|^2}{2\eta_0}\frac{V\cdot QQ'\cdot V'}{V\cdot V'},$$

which is equation (26) in section IV. From step 40, variables M and λ are known. Further, $\eta_o$ represents the impedance of free or empty space (air) and is a constant equal to 377 ohms. As explained in detail in section IV below, the matrix V comprises a 1×M row vector of a real (in the above example) or complex voltage excitations $|V|^2=V\cdot V'$ and V' is the hermitian conjugate of V.

Using the input parameters (of steps 40 and 42) in equation (26), the radiation intensity is determined to be 0.4170. Further, note that the radiation intensity may be expressed in terms of $$\frac{V\cdot QQ'\cdot V'}{V\cdot V'}.$$

To convert the radiation intensity value to watts per unit solid angle, the area of each patch radiator A may be a parameter that is input (step 40), and calculated by computer system 100 using equation (26). As an example, the area A may be equal to 4 $mm^2$.

Referring now to FIG. 5, a flowchart illustrates a method for determining voltages to optimize radiation in a selected direction in accordance with the present invention. More specifically, FIG. 5 is a flowchart illustrating a method for determining voltages (real or complex) to provide optimal radiation intensity $$\frac{dP}{d\Omega}$$

in a selected direction (a given elevation and azimuth). Initially, a plurality of parameters are input to the system (step 50). For purposes of illustration, the input parameters are the same parameters that are input in step 40 of FIG. 4 as discussed above. Further, we will continue to assume that M=6, kh=3.1, elevation angle θ=30°, and azimuth angle ϕ=15°. Again, these variables may be inputted, e.g., in computer system 100 of FIG. 7.

Next, a Q matrix is determined (step 52) preferably using equations (3)–(23) in a similar manner as discussed above with respect to step 44 of FIG. 4. Accordingly, since we are using the same parameters, the Q matrix shown in Table 2 below is equivalent to Table 1:

TABLE 2

| | |
|---|---|
| 0.6050 + 0.1215i | 0.1508 − 0.2720i |
| 0.0028 + 0.7324i | 0.5377 − 0.0412i |
| −0.6866 − 0.7969i | 0.2865 + 0.4250i |
| 0.5882 + 0.2185i | −0.0610 + 0.4104i |
| −0.1178 + 0.6594i | −0.6410 + 0.1042i |
| −0.3915 − 0.9349i | −0.2730 − 0.6264i |

Next, an optimal eigenvalue and optimal eigenvector are determined using equation (26) (step 54). The eigenvalue and eigenvector are preferably selected to provide the strongest radiation intensity value. Both the eigenvalues and eigenvectors are determined using known linear algebra methods to extract the eigenvalues and eigenvectors from the QQ' matrix that optimize the radiation intensity. As discussed below, the Q matrix is a 6×2 matrix and the Q' matrix is a 2×6 matrix, thus the QQ' matrix is a square 6×6. In a 6×6 matrix, 6 eigenvalues and 6 corresponding eigenvectors are inherent. Regarding the 6 eigenvectors and respective eigenvalues, in an n×2 matrix, four (n−2, where n=6) will be 0 values, one will be a large value, and one will be a small value. The large value is deemed to be the "best" (i.e., the optimal) eigenvalue. The corresponding eigenvector is selected as the voltages which will provide the optimal radiation intensity.

In the exemplary embodiment, the optimal eigenvalue is determined to be 3.9594, and the optimal eigenvector (i.e., the optimal voltages) is shown in Table 3. Note that the eigenvector comprises 6 elements, where each element represents a voltage:

TABLE 3

| |
|---|
| 0.3137 − 0.0000i |
| 0.0882 + 0.3496i |
| −0.3543 − 0.3205i |
| 0.3023 + 0.1087i |
| −0.0721 + 0.3484i |
| −0.2778 − 0.4862i |

The optimized radiation intensity (the optimal eigenvalue) is then outputted from computer system 100 (step 56). As stated, the optimized radiation intensity is 3.9594. It is to be noted that that for the same direction (elevation and azimuth angles), this optimized radiation intensity value is almost 10 times stronger than the radiation intensity of FIG. 4 (0.4170) which is determined using arbitrary voltages. Thus, the method of FIG. 5 is preferably used for determining the excitation voltages (real or complex) that provide the optimal radiation intensity $$\frac{dP}{d\Omega}$$

for a given direction (a given elevation and azimuth).

FIG. 6 is a flowchart illustrating a method according to one aspect of the invention for determining voltages (real or complex) to optimize antenna gain in a selected direction (elevation and azimuth) in accordance with the present invention. In essence, the optimal gain will be the "sharpest" radiation beam possible. Initially, a plurality of parameters are input to the system (step 60). For purposes of illustration, the input parameters are the same parameters that are input in step 40 of FIG. 4 as discussed above. Further, we will continue to assume that M=6, elevation angle θ=30°, and azimuth angle ϕ=15°. However, in this example, we will assume that kh=1.8. Once again, these variables may be inputted in computer system 100.

Next, a Q matrix is determined (step 62) preferably using equations (3)–(23) in a similar manner as discussed above with respect to step 44 of FIG. 4. Using the value of kh=1.8, the Q parameters are determined as follows:

TABLE 4

| | |
|---|---|
| 2.5205 − 4.8274i | −0.5724 − 3.1654i |
| 2.6338 + 0.9662i | 0.8274 − 4.0834i |
| −4.8041 + 4.6771i | 2.5030 − 2.7520i |
| 2.7248 − 4.9329i | 1.5289 + 3.1163i |
| 2.2299 + 0.7012i | −0.8064 + 4.3943i |
| −5.3048 + 3.4158i | −3.4804 + 2.4902i |

Next, a gain matrix is determined (step 64). The gain matrix for the exemplary 3×2 patch array will comprise a 6×6 square matrix. Where the Q matrix usually comprises complex numbers, the gain matrix comprises real numbers. The gain matrix is determined by first determining the total power P of the radiation intensity. To determine P, equation (26) is integrated over all directions (not just the selected direction). That is, $$P = \int \frac{dP}{d\Omega} \cdot d\Omega.$$

Further, P is also equal to V·gain matrix·V'. Once the total power P is calculated, the average power may be determined by dividing by 4π. Since Gain=radiation intensity/average power, the gain may be expressed as:

$$\text{Gain} = \frac{V \cdot QQ' \cdot V'}{V \cdot gainmatrix \cdot V'}$$

Note that gain equation has a quadratic form as numerator over a quadratic form as denominator. In the exemplary embodiment, the gain matrix is shown in Table 5 below:

TABLE 5

| | | | | | |
|---|---|---|---|---|---|
| 48.4863 | 7.5039 | −27.2348 | 17.5599 | −14.1921 | −32.1232 |
| 7.5039 | 22.1696 | 7.5039 | −14.1921 | −8.7932 | −14.1921 |
| −27.2348 | 7.5039 | 48.4863 | −32.1232 | −14.1921 | 17.5599 |
| 17.5599 | −14.1921 | −32.1232 | 48.4863 | 7.5039 | −27.2348 |

TABLE 5-continued

| | | | | | |
|---|---|---|---|---|---|
| −14.1921 | −8.7932 | −14.1921 | 7.5039 | 22.1696 | 7.5039 |
| −32.1232 | −14.1921 | 17.5599 | −27.2348 | 7.5039 | 48.4863 |

Once the gain matrix is determined, the eigenvalues and eigenvector of the Q and gain matrices that optimizes the radiation intensity is determined (step 66). More specifically, in a preferred embodiment, standard linear algebra methods are used on the quadratic numerator and quadratic denominator, by computer system 100, to extract or determine the optimal "generalized" eigenvalue and the 6 "generalized" eigenvectors. The "generalized" eigenvalues/eigenvectors are based on the ratio of two quadratic expressions, whereas the eigenvalues/eigenvectors of FIGS. 4 and 5 deal only with a single quadratic expression (the QQ' matrix). The optimal generalized eigenvectors are the optimized excitation voltages (shown in Table 6 below), and the optimal generalized eigenvalue is the optimized gain. In the exemplary embodiment, the optimal gain (i.e. the generalized eigenvalue) is determined to be 2.2428. The optimized voltages and gain are then output from the computer system (step 68).

TABLE 6

| |
|---|
| −0.0591 − 0.4069i |
| 0.3490 − 0.2365i |
| −0.1087 − 0.2653i |
| −0.1825 − 0.4170i |
| 0.0852 − 0.0758i |
| −0.0822 − 0.5866i |

It is to be understood that the exemplary embodiments described above in FIGS. 4–6 are intended to be illustrative only. For instance, the illustrative input and output parameters described above should not be construed as placing any limitation on the scope of the invention. Furthermore, notwithstanding the above exemplary methods are described for differential-mode voltages, the methods and analysis are equally applicable for differential-mode currents. Numerous alternative embodiments may be readily devised by those of ordinary skill in the art based on the teachings herein without departing from the spirit and scope of the invention.

It is to be appreciated that an antenna array operating in differential-mode according to the present invention may advantageously be used efficiently in applications such as airplanes, motor homes, automobiles, buildings, cellular telephones, and wireless modems (to name a few) to transmit and receive large amounts of information with far greater efficiency than is presently available. For example, an airplane may be able to efficiently offer Internet access and movies via an antenna radiating in accordance with the present invention. Further, an antenna radiating in accordance with the present invention may have particular use in a mobile video terminal, such as described in U.S. patent application Ser. No. 09/503,097, entitled "A Mobile Broadcast Video Satellite Terminal and Methods for Communicating with a Satellite".

It is to be further appreciated that the inventive systems and methods described herein that exploit the mutual coupling effect are not limited to patch or other types of antennas. In fact, the invention is applicable to any array of mutually coupled elements. By exploiting the mutual coupling phenomenon, vis-à-vis the conventional thought of inhibiting it, the invention makes possible the efficient transmission and reception of information via any medium that exhibits mutual coupling effects. In addition, the invention is applicable to devices that radiate light and/or heat. For example, a microwave oven may employ the inventive schemes to radiate heat more efficiently. Similarly, a lighting device may employ the inventive schemes to radiate light to, e.g., dry paint, more efficiently.

III. Systems and Methods for Feeding Voltages or Currents

Various devices and methods according to preferred embodiments of the invention for feeding voltages or currents to patch elements in the antenna array 120, to achieve mutual coupling of the array of patches, will now be discussed with reference to FIGS. 8–11.

Figure 8:
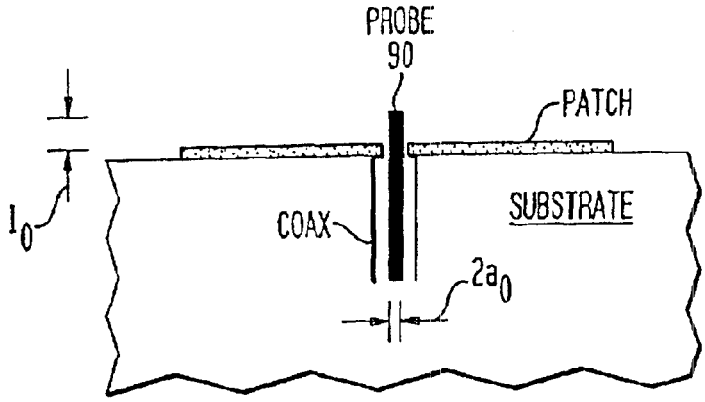
FIG. 8 is a schematic diagram of an apparatus and method for feeding voltages to an antenna array according to an embodiment of the invention.

FIG. 8 depicts one preferred scheme for feeding a patch, which utilizes a short probe 90 that penetrates into the region above the patch. Preferably, the probe 90 comprises an extended portion of the center conductor of a coaxial line that otherwise terminates under the patch. As depicted, the probe 90 may be centered on the patch and perpendicular to the plane of the patch. The probe 90 is thin, of radius $a_o$ and short, of length $l_o$ and is excited by current $I_m$ for patch m. The current enters the probe from below the patch, and the entry point constitutes one of the "ports" of the "circuit". The probe current excites a vertically oriented electric field in the space above the patch. That field can couple one patch to another.

Figure 9:
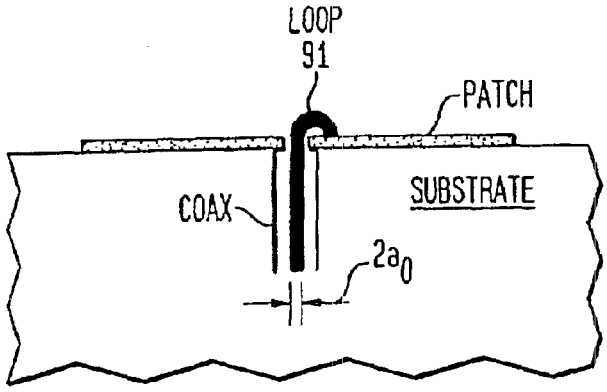
FIG. 9 is a schematic diagram of an apparatus and method for feeding voltages or currents to an antenna array according to another embodiment of the invention.

FIG. 9 depicts another preferred scheme for feeding a patch, which utilizes a small loop 91. Preferably, the loop 91 comprises an extended center conductor of a coaxial line that is formed into a loop of suitable size in the air space above the patch and ends on the patch. The loop can have any convenient shape, not necessarily semicircular. The loop current excites a horizontally oriented magnetic field in the space above the patch, which field can couple one patch to another.

Figure 10:
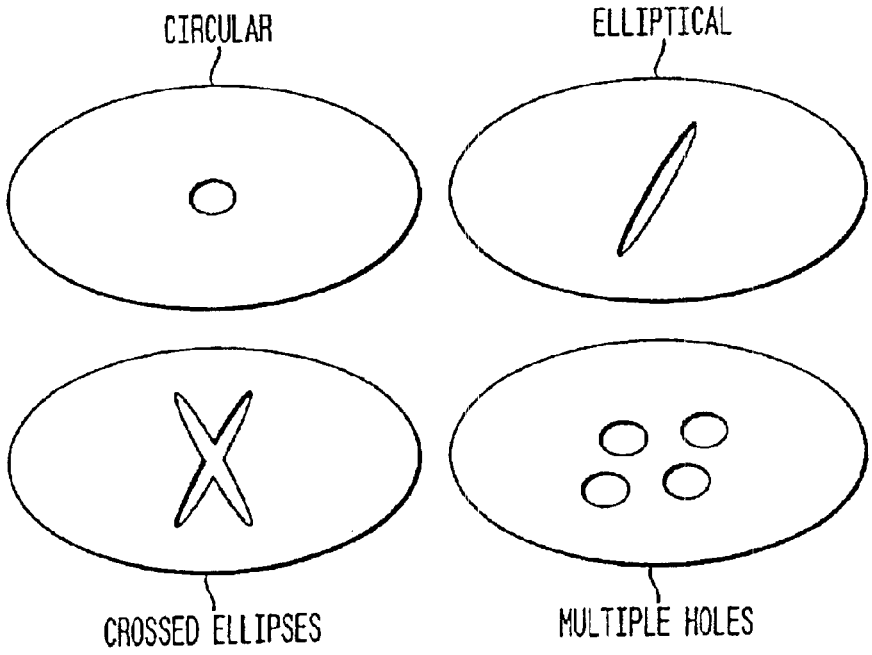
FIG. 10 is a schematic diagram of an apparatus and method for feeding voltages or currents to an antenna array according to another embodiment of the invention.

FIG. 10 depicts other preferred feed schemes, wherein a patch may comprise any one of the illustrated small apertures, designed in accordance with Bethe hole coupling theory, which allow excitation fields under the patch to penetrate to the outer surface. More specifically, one or more holes in the patch, of suitably chosen shapes, allow fields within a suitable structure below the patch, such as a waveguide, to penetrate to the air space above the patch and excite the desired fields, in the desired phase relationship. These fields can couple one patch to another. The design of an excitation scheme of this type can be guided by well known Bethe hole or aperture coupling theory (see, e.g., D. M. Pozar, *Microwave Engineering*, Addison-Wesley Publ. Co., 1990; and R. E. Collin, *Field Theory of Guided Waves*, McGraw-Hill, 1960).

Figure 11:
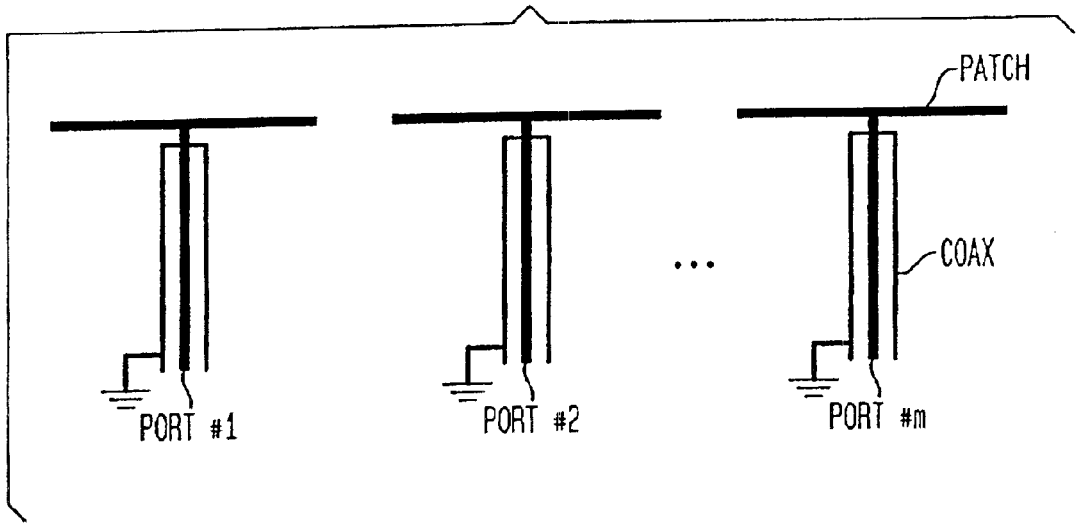
FIG. 11 is a schematic diagram of an apparatus and method for feeding voltages or currents to an antenna array according to another embodiment of the invention.

FIG. 11 depicts another scheme that may be implemented for feeding excitation voltages or currents to a patch antenna array. In this embodiment, coaxial line feeds ("coax") supply the voltages or currents to each patch, as shown in FIG. 11. In such a manner, each patch is its own output port. Instead of applying voltages between patches (which may be done in another embodiment), a connection would be made from the approximate center conductor of a coax to the underside of each patch to deliver the required RF voltage or current. The connection points are centered under each patch, and the outer conductor of each coax is grounded. An array of M patches then has M input ports with which to feed the array.

With the coax outer conductor reaching almost to the patch, any radiation from the open end of the coax is effectively shielded from the outer space above the patches. The feed lines are shielded by the coaxial lines. The antenna radiation will come nearly exclusively from the upper sides of the patches.

A method according to one aspect of the invention for feeding the input ports at the free ends of the coaxial lines will now be described. First, the incident wave amplitudes at each input port, Port 1, Port 2, . . . Port M is determined in terms of the voltages that are required based on the design criteria according to the invention as described herein. At the output ports (i.e., the connections to the patches), the incident and reflected wave amplitudes are listed in the M-dimensional vectors a, b. The reflected wave amplitudes are expressible in terms of the incident ones by the scattering matrix S, as b=Sa. If a "true" scattering matrix is available, either at the output ports or at the input ports, then such matrix should be used. However, if such matrix is not available, then an approximation can be made by constructing the output-port scattering matrix in terms of the mutual capacitance matrix C from equations (1)–(2) in section IV below, for just two patches. Since a+b=V (the voltage vector at the patches), and since a−b is proportional to the currents fed to them, we have $a-b=j\omega Z^oC(a+b)$ or $(I-j\omega Z_oC)a=(I+j\omega Z_oC)b$, where I is the m×m unit matrix, and $Z_o$, is the characteristic impedance of each coax.

Thus, the approximate scattering matrix is $S=(I+j\omega Z_oC)^{-1}(I-j\omega Z_oC)$. The incident wave amplitudes evaluated at the output ports are then $a=(I+S)^{-1}V$, and the incident wave amplitudes required at the input ports to deliver the desired voltages V at the output ports (patches) are listed in the vector A, given by $A=\exp(j\phi)(I+S)^{-1}V$, where $\phi$ is the total phase shift along the coaxial line. Of course, if the coaxial lines are of different lengths, the exponential phase factor becomes a diagonal matrix instead of a scalar. As an example, the length of a coaxial line may be approximately ½ wavelength in size.

IV. Analysis of Radiation of Patch Antenna Array in Differential-Mode Operation

The following section provides a detailed discussion of a method for determining the radiation from an array of patch antennas in differential-mode operation. We develop a model for the field structure in the air space above the patch antenna array when unequal voltages are applied to two or more patches (although it is to be understood that the model described herein is equally applicable for determining the field structure when differential currents are used). As is well known by those of ordinary skill in the art, fields in confined spaces shielded from the outer region are relatively easy to calculate, but we are dealing here with fields in an open structure, which are generally more difficult to compute. We therefore resort to an approximation to the true field pattern, one that conforms to the most important boundary conditions that apply, but that does not account fully for all the fringing that actually occurs. Because of variational principles, the radiation pattern we calculate from these approximate fields is nevertheless more accurate than is the assumed field pattern itself. Indeed, such calculation permits a useful assessment of the radiation from an array of patch antennas operated in differential-mode.

As explained above, FIG. 2 illustrates the postulated field structure from two patch antenna elements on a substrate. FIG. 2 depicts two patch antenna elements deposited on a dielectric substrate that separates the antenna elements from a conducting ground plane. The outer region is air. The two antenna elements have unequal voltages V1 and V2 applied to them. These voltages charge up the elements and an electric field pattern is generated. In the substrate, the fields under the elements are virtually uniform. Within the substrate and beyond the edges of the elements, there are fringing fields but with the assumed field structure, the fringing fields at the edges of the patches are neglected. But the semicircular field lines that couple the patches through the air are the fields that are considered. Although FIG. 2 does not show the fringing fields, such fields exist, as there can not be any discontinuity in the vertical electric field as we move across the region from below an element to between elements. If the substrate is not excessively thick, the effects of the fringing fields are secondary to those of the fields below the elements. The charges on the elements are not confined to the lower surface, however, but distribute themselves on the upper surface as well. When the voltages are not the same, the resultant electric fields in the air run from one conducting element to the other and such fields begin and end perpendicular to the conducting elements.

The field lines in the air trace out some arc from one element to the other, starting and ending vertically, but we can know the precise shape of these arcs only by solving the exterior boundary value problem, which is inherently difficult. Generally, in accordance with the invention, a physically reasonable shape for the field lines in the air is first assumed and then the consequent field strengths are developed on that approximate basis. We retain the all-important requirement of field lines perpendicular to each element at the surface and assume the arc from one element to the other is simply a semicircle. Furthermore, to simplify the subsequent calculations, we also assume that the field strength along any one such semicircular arc is a constant, determined by the voltage difference between the two elements. We neglect fringing fields beyond the edges of the elements, this time within the outer air region, so that we are again ignoring apparent discontinuities in the tangential electric fields beyond the last arcs of the assumed semicircular field lines. With the above approximations, we can proceed to compute the radiation from the antenna elements when these are excited by unequal voltages that oscillate at some given carrier frequency.

Let's assume that the substrate thickness is h, then the electric field strength in the substrate under the first element is $E_1=V_1/h$ and the electric field strength in the substrate under the second element is $E_2=V_2/h$. The field strength along a particular field line in the air in this model is give by $E(r)=(V_1-V_2)/\pi r$, where r denotes the radius of the semicircle. The radius depends on the locations of the two ends of the field line, and is approximately half the geometric separation of the two elements. There is zero field strength in the outer region if the applied voltages are the same, but there will be a nonzero field in the air space whenever differential-mode excitation is applied. FIG. 2 shows orientations of the electric fields appropriate for the case where $V_1>V_2>0$, but the calculation is valid for any pair of voltages.

We can immediately obtain expressions for the self and mutual capacitances of the pair of patches in this model. Assuming the substrate has a permittivity $\epsilon$ and both patches have area A, the charge on the lower surface of the first patch is $A\epsilon E_1=(\epsilon A/h)V_1$ and the charge on the lower surface of the first patch is $A\epsilon E_2=(\epsilon A/h)V_2$. The charge density on the upper surface of the first patch is $(\epsilon_o/\pi r)(V_1-V_2)$, and the charge density on the upper surface of the second patch has an equal and opposite charge per unit area. To simplify the remaining calculation, we assume that the size of each patch is small compared to the relevant radii of the semicircles. Thus, we can then reduce the necessary integrals of 1/r over the patches to the average of 1/r times the patch area A and replace r with an average value. In view of the approximations adopting semicircular field lines, it would be a futile exercise to refine the use of the average radius to the more precise integration of 1/r. Therefore, we accept half the geometric separation between the patches as the average radius. Consequently, the total charge on the two patches is given by:

$$Q_1=(\epsilon A/h+\epsilon_0 A/\pi r)V_1-(\epsilon_0 A/\pi r)V_2=C_{11}V_1+C_{12}V_2 \quad (1)$$

$$Q_2=-(\epsilon_0 A/\pi r)V_1+(\epsilon A/h+\epsilon_0 A/\pi r)V_2=C_{21}V_1+C_{22}V_2 \quad (2)$$

Equations (1) and (2) represent the self and mutual capacitance coefficients or capacitance matrix.

When the applied voltages oscillate at frequency $\omega$, the electric field along the semicircular field lines becomes a displacement current, which can act as a radiating antenna. We want to calculate the radiation pattern from a single semicircular filamentary current. As is well known, this requires a calculation of the Fourier transform of that displacement current. We deal initially with a semicircular current in empty space.

An infinitesimal segment dl of the semicircular displacement current that emerges from the small patch of area A acts as a current element, of moment $$Idl = j\omega\varepsilon_0 EAdl = \frac{jkA(V_1 - V_2)}{\eta_0 \pi r}dl, \quad (3)$$

where $k=\omega/c=2\pi/r$ is the vacuum wavenumber, $\lambda$ denotes the free-space wavelength, and $\eta_o$ is the intrinsic impedance of free space. The far-field radiation vector contributed by this current element is $dN=\exp[jk\cdot r]Idl$, where r is the position vector of the current element, the wavevector is $k=k\hat{n}$, and the unit vector $\hat{n}$ points toward the far-field observation point. Upon integrating along the semicircular arc from one patch to the other, we get the total radiation vector N for this model of the antenna, as the Fourier transform of the displacement current. The radiation pattern is obtained from this in terms of the magnitude squared of the part of the radiation vector that is perpendicular to $\hat{n}$. The radiation intensity, or power per unit solid angle, at the observation point is given by:

$$dP/d\Omega=(\eta_0/8\lambda^2)|N\perp|^2, \text{ with } N\perp=(I-\hat{n}\hat{n})\cdot N \quad (4)$$

The calculation of the radiation intensity as a function of $\hat{n}$ is thereby reduced to a straightforward evaluation of the Fourier transform of the semicircular displacement current. If the location of the current element along the vertical semicircular arc is identified by the angle $\theta$, the position vector can be expressed as:

$$r(\theta)=\hat{z}r\sin\theta-\hat{s}r\cos\theta \text{ for } 0<\theta<\pi \quad (5)$$

where $\hat{z}$ is a unit vector in the vertical direction (perpendicular to the patch surface), $\hat{s}$ is a horizontal unit vector in the direction from the first patch to the second one, and we have put the origin at the center of the semicircle. The element of length is then:

$$dl = \frac{dr}{d\theta}d\theta = r(\hat{z}\cos\theta + \hat{s}\sin\theta)d\theta \quad (6)$$

and the radiation vector is:

$$\begin{aligned} N &= \int \frac{jkA(V_1 - V_2)}{\eta_o \pi r}\exp[jk\cdot r]dl \\ &= \frac{(V_1 - V_2)jA}{\eta_o \pi r}\int_0^{\pi}\exp[jk\cdot r]k\frac{dr}{d\theta}d\theta \\ &= \frac{(V_1 - V_2)jA}{\eta_o \pi r}J(a, b) \end{aligned} \quad (7)$$

We have abbreviated the integral as $$\int_0^{\pi} \exp(jkr[\hat{n}\cdot\hat{z}\sin\theta - \hat{n}\cdot\hat{s}\cos\theta])kr(\hat{z}\cos\theta + \hat{s}\sin\theta)d\theta,$$

and can be written as:

$$J(a, b) = \frac{\hat{z}}{\hat{n}\cdot\hat{z}}\int e^{j(u-v)}du - \frac{\hat{s}}{\hat{n}\cdot\hat{s}}\int e^{j(u-v)}dv \tag{8}$$

where $a=kr\hat{n}\cdot z$, $b=kr\hat{n}\cdot\hat{s}$, $u=a\sin\theta$, $v=b\cos\theta$. (9)

The integral J(a, b) is not elementary, although $\hat{n}\cdot J(a,b)$ is trivial, being equal to 2 sin b. The other two components of the vector J(a, b) are needed for the radiation intensity. For theoretical purposes, J(a, b) can be expressed via a Fourier series as an infinite series of Bessel functions or, alternatively by expanding the integrand in a Taylor series, in terms of beta functions. But for practical calculations, it is more expedient to recast it in terms of a difference equation or recursion relation, as follows.

Upon expanding the exp(−jv) factor in the u-integral and the exp(ju) factor in the v-integral in power series, we find that J(a, b) can be expressed as:

$$J(a, b) = \frac{\hat{z}}{\hat{n}\cdot\hat{z}}\sum_{n=0}^{\infty} t^n Z_n(a) - \frac{\hat{s}}{\hat{n}\cdot\hat{s}}\sum_{n=0}^{\infty} t^{-n} S_n(b) \tag{10}$$

where $t=b/a=\hat{n}\cdot\hat{s}/\hat{n}\cdot\hat{z}$. The coefficients in the power series are:

$$S_n(b) = \int_{\theta=0}^{\pi} \frac{(jtu)^n}{n!} e^{-jv} dv, \tag{11}$$

$$Z_n(b) = \int_{\theta=0}^{\pi} \frac{(v/jt)^n}{n!} e^{ju} du, \tag{12}$$

In the integral for $Z_n(a)$, we can let w=v/jt and note that $u^2-w^2=a^2$, so that wdw=udu. Upon integrating twice by parts (using exp(ju) as a part) and substituting $a^2+w^2$ for $u^2$, we find the recursion relation:

$$Z_n(a)+Z_{n-2}(a)+c_n(a)Z_{n-4}(a)=fn(a) \tag{13}$$

where $$c_n(a) = \frac{a^2}{(n-1)(n-3)} \tag{14}$$

$$f_n(a) = 2(-1)^{(n-1)/2}\frac{a^n}{n!} \tag{15}$$

and the relation holds for n odd and n>4. We also find that $Z_n(a)=0$ for n even. Similarly, with the same operations applied to the integral for $S_n(b)$, we find the recursion relation:

$$S_n(b)+S_{n-2}(b)+c_n(b)S_{n-4}(b)=0 \tag{16}$$

this time for all n>3, even and odd. Both recursion relations are stable when run backwards. However, there is no need to run both recurrences, as the identity $\hat{n}\cdot J(a,b)=2\sin b$, mentioned earlier, allows the Z sum to be expressed in terms of the S sum, so that recursion on the homogeneous equation is sufficient. The efficient calculation of J(a, b) is then effected through the quantity $G(\hat{n})=J(a,b)/kr$ as $$G(\hat{n}) = 2\hat{s}\sin\frac{b}{b} + \left(\frac{\hat{z}}{a} - \frac{\hat{s}}{b}\right)\sum_{n=1}^{\infty}(a/b)^n S_n(b) \tag{17}$$

with downward recursion of the equation for S, terminating in $S_o(b)=-2\sin b$ for the even-numbered ones and in $S_1(b)$ for the odd ones; this last one is easily calculated from its power series. The components of the vectors J(a, b) and $G(\hat{n})$ are complex and are oscillatory functions of a and b, similar to Bessel functions in their behavior.

Next, we calculate the radiation from one pair of patches. For calculation of the radiation pattern, the directly relevant quantity is $G(\hat{n})$, which enters into the equation for the radiation intensity as:

$$\frac{dP}{d\Omega} = \frac{|V_1 - V_2|^2}{2\eta_0}\frac{A^2}{\lambda^4}|G_\perp|^2,\ G_\perp = (I - \hat{n}\,\hat{n})\cdot G(\hat{n}) \tag{18}$$

It is therefore the magnitude squared of the part of the complex vector G that is perpendicular to the direction $\hat{n}$ of the observation point that gives the radiation pattern for the semicircular displacement current. The parameter $kr=\pi d/\lambda$ in both a and b involves the ratio of the separation d between the two patches (the diameter of the semicircle) to the wavelength λ.

Figure 12A:
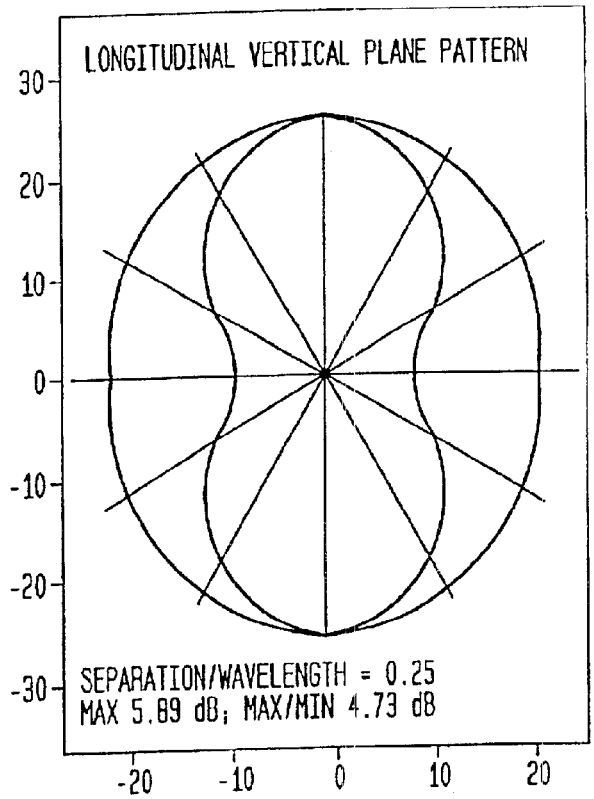
FIGS. 12*a* and 12*b* illustrate radiation patterns for a longitudinal vertical plane and a transverse vertical plane, respectively, for a pair of patches ¼ wavelength apart, which are determined using a differential-mode excitation method according to the invention.
Figure 12B:
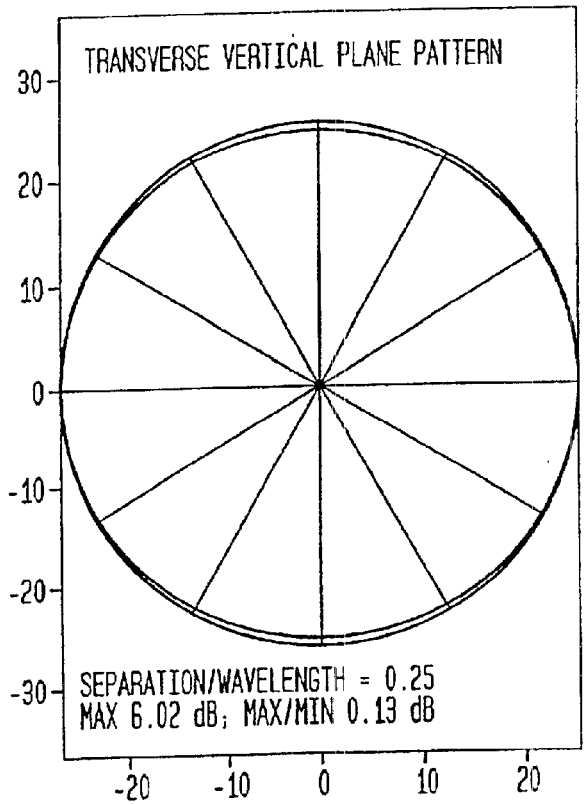
Figure 13A:
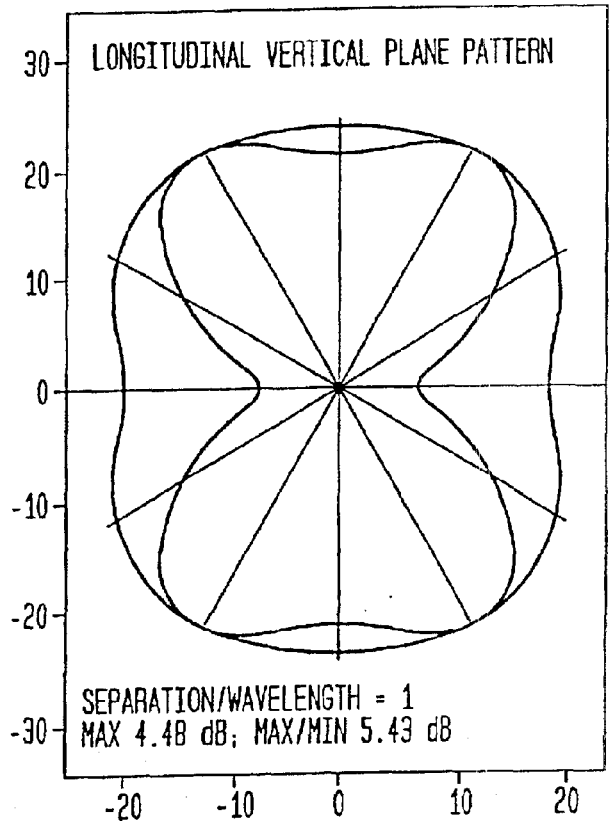
FIGS. 13*a* and 13*b* illustrate radiation patterns for a longitudinal vertical plane and a transverse vertical plane, respectively, for a pair of patches 1 wavelength apart, which are determined using a differential-mode excitation method according to the invention.
Figure 13B:
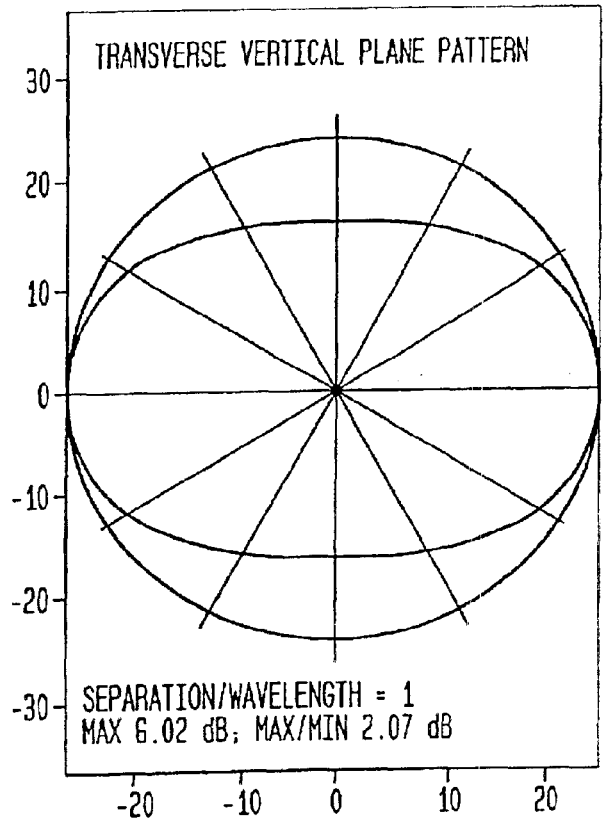
Figure 14A:
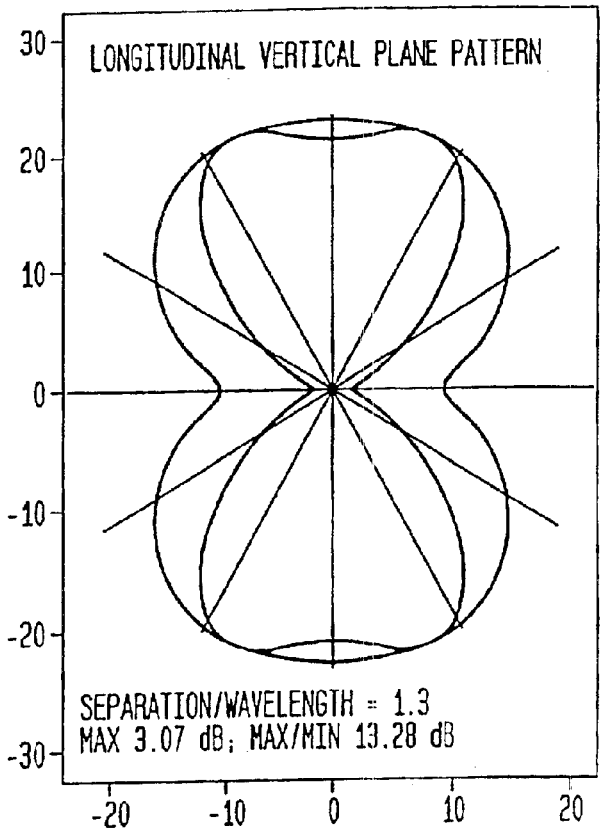
FIGS. 14*a* and 14*b* illustrate radiation patterns for a longitudinal vertical plane and a transverse vertical plane, respectively, for a pair of patches 1.3 wavelengths apart, which are determined using a differential-mode excitation method according to the invention.
Figure 14B:
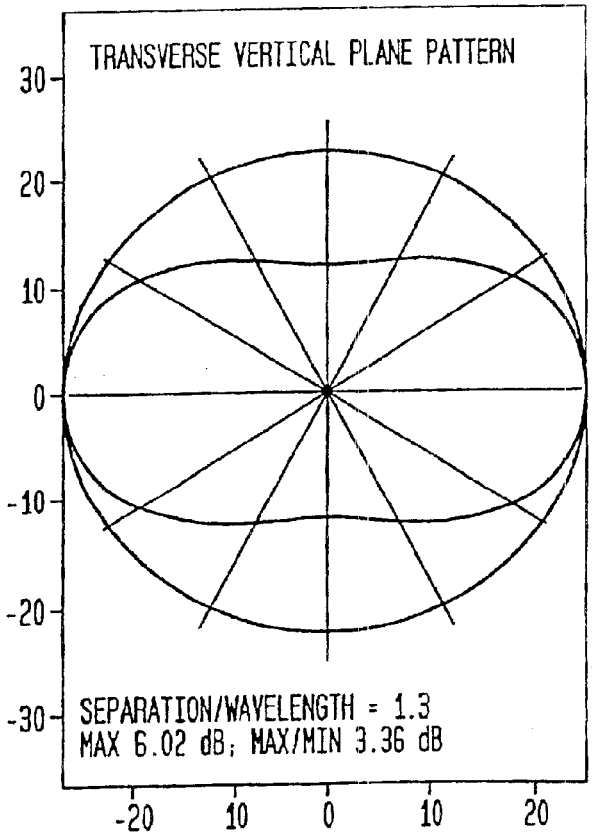

FIGS. 12, 13 and 14 are diagrams of polar plots, in two planes, illustrating calculated radiation patterns for a semicircular current in free space, for three different values of a separation-to-wavelength ratio d/λ. More specifically, FIGS. 12*a* and 12*b* illustrate radiation patterns for the longitudinal vertical plane and transverse vertical plane, respectively, for a pair of patches $$\frac{1}{4}$$

wavelength apart. FIGS. 13*a* and 13*b* illustrate radiation patterns for the longitudinal vertical plane and transverse vertical plane, respectively, for a pair of patches 1 wavelength apart. FIGS. 14*a* and 14*b* illustrate radiation patterns for the longitudinal vertical plane and transverse vertical plane, respectively, for a pair of patches 1.3 wavelengths apart.

The longitudinal vertical plane is the plane of the semicircle and includes the locations of the two patches, and this is the plane formed by the unit vectors $\hat{s}$ and $\hat{z}$. The transverse vertical plane bisects the line from one patch to the other, and it includes $\hat{z}$ but is perpendicular to $\hat{s}$. Each plot depicted in FIGS. 12–14 shows two tracings of the radiation pattern: the inner tracing is a linear plot and the outer tracing is logarithmic, in dB. For convenience in plotting, both have been scaled to the same peak value. The legends indicate the patch separation in wavelengths and also furnish the peak value of $|G\perp|^2$ in dB, as well as the ratio of the maximum to the minimum value of the pattern, in dB.

It is to be noted that that neither the substrate nor the ground plane is included in the calculation of these patterns. Their effects are dealt with later, using these results as incident fields. The present patterns furnish the radiation from semicircular uniform currents in empty space.

Besides the cases depicted in the figures, additional calculations confirm that for small separations of the patches, the radiation pattern reverts to that for a horizontally oriented dipole, with a null in the direction of the pair of patches and an isotropic pattern in the transverse plane, as may be expected. We also find that, for a patch separation of 0.6 wavelengths, the radiation pattern is nearly isotropic, to within a fraction of a dB, in both planes. For large separations, the pattern becomes more scalloped.

We can now extend these results for a single pair of patches with unequal excitations to an array of patches with differential-mode excitation. Consider an array of M patches, each patch having an area A. It is to be understood that it is not necessary for the patches to be distributed in space systematically, although a uniformly spaced array in the plane atop the substrate may be a practical implementation. The p-th patch is located at $r_p$ and is excited by complex voltage $V_p$. Any pair of these patches, identified by p and q, results in a semicircular displacement current in our model, from patch p to patch q, provided that $V_p \neq V_q$. The center of the semicircular arc is at $r_{pq}=(r_p+r_q)/2$ and this introduces a phase factor $\exp(jk\cdot r_{pq})$ into the expression for the radiation vector for this pair of elements. We need to sum over all pairs of patches to get the overall radiation vector. There are M(M−1)/2 distinct pairs. For example, for a 5×5 array of 25 elements, there are 300 radiating semicircular arcs. To handle this multiplicity of radiators efficiently, we resort of course to a matrix description.

The expression for the radiation vector created by the entire array becomes:

$$N = \frac{jkA}{\eta_0} \sum_{all\ p,q} \sum_{with\ p<q} (V_p - V_q)\exp(jk \cdot r_{pq})[J(a, b)/kr]_{pq} \tag{19}$$

where the double sum is over all p and q (each running from 1 to M), except that in order to count each semicircular arc only once, the sums are restricted to p<q and there are M(M−1)/2 terms in the double sum. In the expressions for kr and therefore also for a and b in J(a, b), the radius r of the semicircle from p to q is given by $r=|(r_q-r_p)/2|$. We also have that the unit vector ŝ, which is directed from $r_p$ to $r_q$, is different for the different semicircles and also ought to be subscripted.

To convert this expression for the radiation vector into its matrix equivalent, we note the identity that $$\sum_{all\ p,q} \sum_{with\ p<q} (V_p - V_q)X_{pq} \tag{20}$$

is equivalent to $$\sum_{all\ p} \sum_{all\ q} V_p Y_{pq} \tag{21}$$

provided that $$Y_{pq}=X_{pq}(p<q),$$
$$Y_{pq}=0\ (p=q),$$
$$Y_{pq}=-X_{qp}(p>q). \tag{22}$$

The quantities $Y_{pq}$ can be seen to be the elements of an antisymmetric M×M matrix Y (except that each element in the present situation is actually a three-dimensional vector instead of merely a scalar). The antisymmetry of Y captures the essence of differential-mode operation of the patch array. Finally, the double sum is now reducible to a single sum, as the sum over q simply means summing the colunms of Y to arrive at an M-element column matrix W (whose elements are still three-dimensional vectors):

$$\sum_{p=1}^{M} \sum_{q=1}^{M} V_p Y_{pq} = \sum_{p=1}^{M} V_p W_p = N. \tag{23}$$

There remains to extract the part of vector N that is perpendicular to the unit vector n̂. If N is written as a three-component row vector, N⊥ is obtainable as proportional to N·H, where H is an orthonormal basis for the null space of n̂ (H is a 3×2 matrix). To keep the numerical values in a convenient range, we also factor out the number of patches, M. Applying this to the W matrix, expressed as an M×3 matrix, yields the M×2 matrix Q as W·H. The manipulations that yield Q from $Xpq=\exp(jk\cdot r_{pq})[J(a,b)/kr]_{pq}$ are straightforward. Finally, we obtain:

$$N\perp=(jkAM/\eta_0\pi)V\cdot Q \tag{24}$$

and $$\frac{dP}{d\Omega} = \frac{\eta_0 |N_\perp|^2}{8\lambda^2} = \frac{M^2A^2}{\lambda^4}\frac{|V|^2}{2\eta_0}\left|V\cdot Q\frac{|^2}{|V|^2}\right., \tag{25}$$

where V is a 1×M row vector of complex voltage excitations and Q=Q(n̂) is an M×2 matrix that depends on the direction of the observation point and on the geometry of the patch array, but not on the excitations. If we denote the hermitian conjugate (complex conjugate transpose) of a matrix by a prime, we recognize $|V|^2=V\cdot V'$ and the radiation pattern becomes:

$$\frac{dP}{d\Omega} = \frac{M^2A^2}{\lambda^4}\frac{|V|^2}{2\eta_0}V\cdot Q\frac{Q'\cdot V'}{V\cdot V'} \tag{26}$$

It is to be noted that MA is the total geometrical area of the patches, excluding the spacing between them. The real scalar factor, F=VQQ'V'/VV', carries the directional information and gives the pattern as a homogeneous expression in the excitations V (unaffected by any common factors in the elements of V). For any given excitations, F gives the radiation in any direction for which Q has been calculated.

The expression for F is also variational, in that it becomes stationary when V' is an eigenvector of the hermitian matrix QQ' (with F as the eigenvalue). We can therefore maximize the radiation in some direction for which Q has been calculated by choosing the excitations V so as to make it the row eigenvector of QQ' corresponding to the largest eigenvalue. Although QQ' is an M×M matrix, there is no difficulty in obtaining the eigenvalues, as the nonzero eigenvalues are the same as those of Q'Q, which is merely 2×2. The corresponding M-component row eigenvector V of the M×M matrix QQ' is just the 2-component eigenvector of the 2×2 matrix Q'Q, postmultiplied by the 2×M matrix Q'.

Again it is to be understood that although the above exemplary analysis and methods are described for differential-mode voltages, those of ordinary skill in the art can readily apply such analysis and methods for differential-mode currents based on the teachings herein.

Figure 15A:
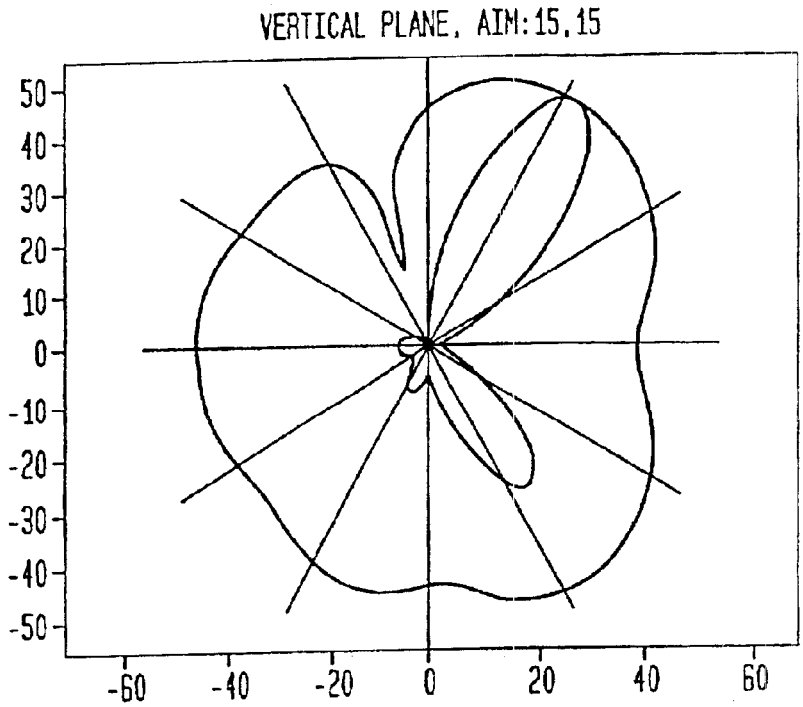
FIG. 15*a* is an exemplary diagram illustrating a radiation pattern in a vertical plane for a 4×4 square patch antenna array in free space, which is determined using a differential-mode excitation method according to the invention.

FIG. 15*a* is an exemplary diagram illustrating a radiation pattern in a vertical plane calculated in this manner for a 4×4 square patch antenna array in free space. The patches are separated by 0.6λ along both the x- and y-directions. With 16 patches, there are 16×15/2=120 semicircular arcs in the model and the QQ' matrix is 16×16, but its nonzero eigenvalues are the same as those of the 2×2 matrix Q'Q. For this example, we have chosen to maximize the radiation intensity obtainable in a direction given by an elevation angle of 15 degrees from the zenith and an azimuthal angle of 15 degrees from the x-axis (which is along one side of the square array). Note that this condition by itself does not place the maximum radiation intensity in that direction (the peak is actually at about 32 degrees), but it furnishes the most intensity obtainable in that direction for any possible set of the 16 complex excitations of the patches. In FIG. 15*a*, the inner radiation plot is linear and the outer radiation plot is in dB. The tic marks on the frame of the plot are spaced 10 dB apart. The pattern is in a vertical plane that includes the direction of maximization. The substrate and ground plane are omitted from the model, so that the array is assumed to be in empty space.

Figure 15B:
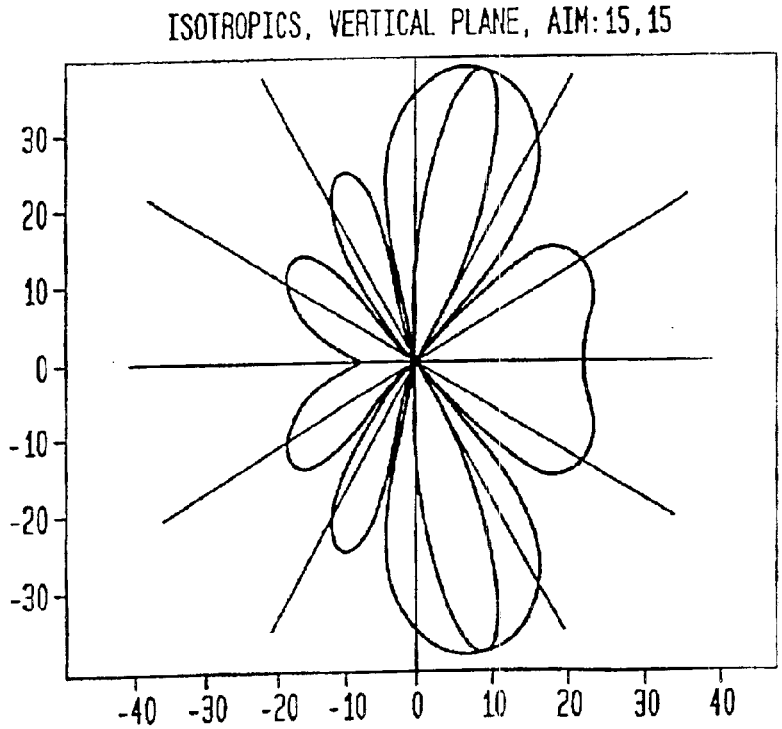
FIG. 15*b* is an exemplary diagram illustrating a radiation pattern in a vertical plane for a 4×4 square array of uncoupled isotropic radiators, in free space.

FIG. 15*b* is an exemplary diagram illustrating a radiation pattern in a vertical planes for a 4×4 array of uncoupled isotropic radiators, in free space. FIG. 15*b* is presented for comparison with FIG. 15*a*, using the same 4×4 array with the same spacing and phased to aim the beam in the same direction. The sidelobes are evident in the outer, dB plot. There are two main beams, because this array is deemed to lie in a plane in empty space. That symmetry is lacking in the case of the patch antenna array, as the semicircular arcs in the mode are considered to extend only on one side of the plane.

In conclusion, radiation from a patch antenna array of two or more elements emanates not merely from the edges of the patches, as is the common presumption, but from the coupling fields that join any pair of patches for which the voltages applied to the elements differ. These coupling fields in the air above the patches oscillate in time and therefore constitute displacement currents that radiate outwards into space. These fields arc from one patch to another, necessarily beginning and ending perpendicular to the conducting patch surfaces.

As a convenient approximation, we assume that the arcs are semicircles and that the field strength along these arcs can be replaced by their average value. The Fourier transform of these assumed fields gives the radiation pattern in any direction. For any array so modeled, we have succeeded in calculating the radiation pattern efficiently, by reducing the calculation to the solution of a simple, stable recurrence relation.

We have presented radiation patterns of pairs of patches with various separations and also of an array of 16 patches. The radiation intensity varies as the fourth power of the linear dimension of the array or of the number of elements on a side of the array. We have given the formula for the radiation pattern in a form that exhibits variational properties and separates the dependence on the patch excitation voltages from its variation with direction. The array need not be square or even regularly spaced.

We have presented the simplest results, for semicircular coupling fields that exist in empty space, without accounting for the dielectric substrate and for the ground plane. The ground plane is easily included by using image semicircular arcs. The dielectric substrate can be accounted for by an application of the equivalence principle to reduce the inhomogeneous problem to two separate but linked homogeneous problems. The form of the equation for the radiation pattern is well suited to the determination of optimized excitation voltages to achieve some beam shaping. We can account for the ground plane and for the substrate, and can impose nulls or otherwise shape the radiation, and the methods apply to irregularly spaced arrays.

Although illustrative embodiments have been described herein with reference to the accompanying drawings, it is to be understood that the present system and method is not limited to those precise embodiments, and that various other changes and modifications may be effected therein by one skilled in the art without departing from the scope or spirit of the invention. All such changes and modifications are intended to be included within the scope of the invention as defined by the appended claims.

What is claimed is:

1. An antenna system, comprising:

an array of radiating elements;

a control system for generating differential-mode voltages or differential-mode currents for exciting the radiating elements; and a device for feeding the differential-mode voltages or differential-mode currents to the radiating elements, wherein the differential-mode voltages or differential-mode currents are applied to the radiating elements to generate a radiation beam that exploits mutual coupling among the radiating elements in the array, wherein the control system comprises a computer for performing the steps of (i) calculating a matrix of complex numbers that is dependent on a direction of observation of radiation intensity emitted by the antenna system and on a geometry of the array of radiating elements, but is independent of voltage or current excitations of the array, wherein the matrix describes radiation in a far field and reflects mutual coupling effects of each radiating element in the array among all of the other radiating elements in the array, and (ii) calculating a radiation intensity in the direction of observation using the calculated matrix, and actual voltages or currents fed at each of the radiating elements in the array.

2. The antenna system of claim 1, wherein the control system comprises a radiation model that exploits the mutual coupling among the radiating elements and uses the calculated matrix to determine optimal differential-mode voltages or differential-mode currents for one of steering the beam, shaping the beam and optimizing a gain of the antenna in a desired direction, based on at least one input parameter.

3. The antenna system of claim 1, further comprising an input to the computer for inputting geometric parameters of the antenna system including at least one of the number of the radiating elements, a separation distance between the radiating elements, an elevation angle of the radiation beam to be emitted from the antenna system, and an azimuth angle of the radiation beam to be emitted from the antenna system to be used by the computer to calculate the matrix of complex numbers.

4. The antenna system of claim 1, wherein the antenna system is a microstrip patch antenna or a monolithic microwave integrated circuit (MMIC) antenna array that is caused to radiate from its entire top surface of the radiating elements in the array.

5. The antenna system of claim 1, wherein the array is planar or non-planar.

6. The antenna system of claim 1, wherein a spacing between the radiating elements in the array is regular.

7. The antenna system of claim 1, wherein the array of radiating elements has a top side and a bottom side; and wherein the device for feeding the differential-mode voltages or differential-mode currents to the radiating elements comprises:

at least one probe for feeding one of the radiating elements with one of the voltages or currents, wherein the one of the radiating elements has an aperture through which a top end of the at least one probe passes from the bottom side of the one of the radiating elements to the top side of the one of the radiating elements such that a top end of the probe extends above the aperture to generate the mutual coupling of the radiating elements from the top side of the radiating elements.

8. The antenna system of claim 7, wherein the probe comprises a center conductor of a coaxial cable.

9. The antenna system of claim 7, wherein the probe may be centered on the respective patches to exploit the mutual coupling among the radiating elements.

10. The antenna system of claim 1, wherein the array of radiating elements has a top side and a bottom side; and wherein the device for feeding the differential-mode voltages or differential-mode currents to the radiating elements comprises:

at least one probe for feeding one of the radiating elements with one of the voltages or currents, wherein the one of the radiating elements has an aperture through which a top end of the at least one probe passes from the bottom side of the one of the radiating elements to the top side of the one of the radiating elements such that a top end of the probe extends above the aperture and is looped over to contact the top side of the respective radiating element to generate the mutual coupling of the radiating elements from the top side of the radiating elements.

11. The antenna system of claim 1, wherein at least some of the radiating elements in the array comprise one or more apertures; and wherein the differential-mode voltages or differential-mode currents are applied to the radiating elements to generate a radiation beam that utilizes and exploits mutual coupling among the radiating elements in the array, wherein the device feeds the voltages or currents from below the radiating elements and wherein the mutual coupling is generated by electromagnetic fields below the radiating elements extending through the one or more apertures in the radiating elements.

12. The antenna system of claim 1, wherein the array of radiating elements has a top side and a bottom side; and wherein the device for feeding the differential-mode voltages or differential-mode currents to the radiating elements comprises:

a plurality of probes for feeding at least some of the radiating elements with different voltages or currents, wherein a plurality of the radiating elements to which voltages or currents are fed each have an aperture through which a top end of one of the probes passes from the bottom side of the radiating elements to the top side of the radiating elements such that top ends of the probes extend above the apertures to generate the mutual coupling of the radiating elements from the top side of the radiating elements.

13. The antenna system of claim 1, wherein the array of radiating elements has a top side and a bottom side; and wherein the device for feeding the differential-mode voltages or differential-mode currents to the radiating elements comprises:

a plurality of probes for feeding at least some of the radiating elements with different voltages or currents, wherein a plurality of the radiating elements to which voltages or currents are fed each have an aperture through which a top end of one of the probes passes from the bottom side of the radiating elements to the top side of the radiating elements such that top ends of the probes extend above the apertures and are looped over to contact the top side of the respective radiating element to generate the mutual coupling of the radiating elements from the top side of the radiating elements.

14. An antenna system, comprising:

an array of radiating elements;

control system for generating differential-mode voltages or differential-mode currents for exciting the radiating elements; and a device for feeding the differential-mode voltages or differential-mode currents to the radiating elements, wherein the differential-mode voltages or differential-mode currents are applied to the radiating elements to generate a radiation beam that accounts for mutual coupling among the radiating elements in the array, wherein the control system comprises a computer for performing the steps of (i) calculating a matrix of complex numbers that is dependent on a direction of observation of radiation intensity emitted by the antenna system and on a geometry of the array of radiating elements, but is independent of voltage or current excitations of the array, and (ii) calculating a radiation intensity in the direction of observation using the calculated matrix, and actual voltages or currents fed at each of the radiating elements in the array, wherein the computer further performs the step of calculating the radiation intensity $dP/d\Omega$ proportional to the following expression:

$$f=c\cdot QQ'\cdot c'/c\cdot c'$$

where c is a vector representable by a 1×M matrix of either currents or voltages to be applied to each of the radiating elements of the array of which there are M radiating elements c' is the Hermitian conjugate of the c vector, Q is the matrix of complex numbers, and Q' is the Hermitian conjugate of the Q matrix.

15. The antenna system of claim 14, wherein the Q matrix is an M×2 matrix where M is the number of the radiating elements in the array.

16. An antenna system, comprising:

an array of radiating elements;

a control system for generating differential-mode voltages or differential-mode currents for exciting the radiating elements; and a device for feeding the differential-mode voltages or differential-mode currents to the radiating elements, wherein the differential-mode voltages or differential-mode currents are applied to the radiating elements to generate a radiation beam that accounts for mutual coupling among the radiating elements in the array, wherein the control system comprises a computer for performing the steps of (i) calculating a matrix of complex numbers that is dependent on a direction of observation of radiation intensity emitted by the antenna system and on a geometry of the array of radiating elements, but is independent of voltage or current excitations of the array, and (ii) calculating a radiation intensity in the direction of observation using the calculated matrix, and actual voltages or currents fed at each of the radiating elements in the array, wherein a spacing between the radiating elements in the array is irregular.

17. An antenna system, comprising:

an array of radiating elements;

a control system for generating differential-mode voltages or differential-mode currents for exciting the radiating elements; and a device for feeding the differential-mode voltages or differential-mode currents to the radiating elements, wherein the differential-mode voltages or differential-mode currents are applied to the radiating elements to generate a radiation beam that exploits mutual coupling among the radiating elements in the array, wherein the control system comprises a computer for performing the steps of (i) calculating a first matrix of complex numbers that is dependent on a direction of observation of radiation intensity emitted by the antenna system and on a geometry of the array of radiating elements, but is independent of voltage or current excitations of the array, (ii) multiplying the first matrix by its Hermitian conjugate matrix to obtain a second matrix;

(iii) determining eigenvalues and eigenvectors of the second matrix, and (iv) selecting the voltages or currents to be fed to each of the radiating elements in the array based on one of the eigenvectors to achieve an optimal radiation intensity in the direction of observation.

18. The antenna system of claim 17, wherein the computer is designed to perform the step of selecting the voltages or currents to achieve the optimal radiation intensity by selecting the voltages or currents to be the row eigenvector of the second matrix that corresponds to the largest eigenvalue of the second matrix.

19. The antenna system of claim 17, wherein the computer further performs the step of calculating the radiation intensity $dP/d\Omega$ proportional to the following expression:

$$f=c\cdot QQ'\cdot c'/c\cdot c'$$

where c is a vector representable by a 1×M matrix of either currents or voltages to be applied to each of the radiating elements of the array of which there are M radiating elements, c' is the Hermitian conjugate of the c vector, Q is the matrix of complex numbers, and Q' is the Hermitian conjugate of the Q matrix.

20. The antenna system of claim 17, wherein the first matrix is an M×2 matrix wherein M is the number of the radiating elements.

21. The antenna system of claim 17, wherein the calculation of the first matrix is based at least in part on the number of the radiating elements, the separation distance between the radiating elements, the elevation angle of the radiation beam to be emitted from the antenna system, and the azimuth angle of the radiation beam to be emitted from the antenna system.

22. The antenna system of claim 17, wherein the antenna system is a microstrip patch antenna or a monolithic microwave integrated circuit (MMIC) antenna array.

23. The antenna system of claim 17, wherein the array is planar or non-planar.

24. The antenna system of claim 17, wherein a spacing between the radiating elements in the array is regular.

25. The antenna system of claim 17, wherein a spacing between the radiating elements in the array is irregular.

26. The antenna system of claim 17, wherein the array of radiating elements has a top side and a bottom side; and wherein the device for feeding the differential-mode voltages or differential-mode currents to the radiating elements comprises:

at least one probe for feeding one of the radiating elements with one of the voltages or currents, wherein the one of the radiating elements has an aperture through which a top end of the at least one probe passes from the bottom side of the one of the radiating elements to the top side of the one of the radiating elements such that a top end of the probe extends above the aperture to generate the mutual coupling of the radiating elements from the top side of the radiating elements.

27. The antenna system of claim 26, wherein the probe comprises a center conductor of a coaxial cable.

28. The antenna system of claim 26, wherein the probe may be centered on the respective patches to exploit the mutual coupling among the radiating elements.

29. The antenna system of claim 17, wherein the array of radiating elements has a top side and a bottom side; and wherein the device for feeding the differential-mode voltages or differential-mode currents to the radiating elements comprises:

at least one probe for feeding one of the radiating elements with one of the voltages or currents, wherein the one of the radiating elements has an aperture through which a top end of the at least one probe passes from the bottom side of the one of the radiating elements to the top side of the one of the radiating elements such that a top end of the probe extends above the aperture and is looped over to contact the top side of the respective radiating element to generate the mutual coupling of the radiating elements from the top side of the radiating elements.

30. The antenna system of claim 17, wherein at least some of the radiating elements in the array comprise one or more apertures; and wherein the differential-mode voltages or differential-mode currents are applied to the radiating elements to generate a radiation beam that utilizes and exploits mutual coupling among the radiating elements in the array, wherein the device feeds the voltages or currents from below the radiating elements and wherein the mutual coupling is generated by electromagnetic fields below the radiating elements extending through the one or more apertures in the radiating elements.

31. The antenna system of claim 17, wherein the array of radiating elements has a top side and a bottom side; and wherein the device for feeding the differential-mode voltages or differential-mode currents to the radiating elements comprises;

a plurality of probes for feeding at least some of the radiating elements with different voltages or currents, wherein a plurality of the radiating elements to which voltages or currents are fed each have an aperture through which a top end of one of the probes passes from the bottom side of the radiating elements to the top side of the radiating elements such that top ends of the probes extend above the apertures to generate the mutual coupling of the radiating elements from the top side of the radiating elements.

32. The antenna system of claim 17, wherein the array of radiating elements has a top side and a bottom side; and wherein the device for feeding the differential-mode voltages or differential-mode currents to the radiating elements comprises:

a plurality of probes for feeding at least some of the radiating elements with different voltages or currents, wherein a plurality of the radiating elements to which voltages or currents are fed each have an aperture through which a top end of one of the probes passes from the bottom side of the radiating elements to the top side of the radiating elements such that top ends of the probes extend above the apertures and are looped over to contact the top side of the respective radiating element to generate the mutual coupling of the radiating elements from the top side of the radiating elements.

33. An antenna system, comprising:

an array of radiating elements;

a control system for generating differential-mode voltages or differential-mode currents for exciting the radiating elements; and a device for feeding the differential-mode voltages or differential-mode currents to the radiating elements, wherein the differential-mode voltages or differential-mode currents are applied to the radiating elements to generate a radiation beam that exploits mutual coupling among the radiating elements in the array, wherein the control system comprises a computer for performing the steps of (i) calculating a first matrix Q of complex numbers that is dependent on a direction of observation of radiation intensity emitted by the antenna system and on a geometry of the array of radiating elements, but is independent of voltage or current excitations of the array, (ii) multiplying the first matrix by its Hermitian conjugate matrix Q' to obtain a second matrix QQ';

(iii) calculating a gain matrix G by averaging the second matrix over all solid angles;

(iv) determining an optimal generalized eigenvalue and eigenvector obtained from a ratio of $c \cdot QQ' \cdot c' / c \cdot G \cdot c'$, wherein c represents a matrix of voltages or currents to be applied to the radiating elements, c' represents the Hermitian conjugate of the c matrix; and (v) determining an optimal gain which corresponds to the optimal generalized eigenvalue and determining the voltages or currents to be fed to each of the radiating elements in the array from the corresponding generalized eigenvector to achieve an optimal gain function in the direction of observation.

34. The antenna system of claim 33, wherein the computer further performs the step of calculating the radiation intensity $dP/d\Omega$ proportional to the following expression:

$$f = c \cdot QQ' \cdot c' / c \cdot c'$$

wherein c is a vector representable by a 1×M matrix of either currents or voltages to be applied to each of the radiating elements of the array of which there are M radiating elements.

35. The antenna system of claim 33, wherein the Q matrix is an M×2 matrix wherein M is the number of the radiating elements.

36. The antenna system of claim 33, wherein the computer further comprises an input for inputting at least one of the number of the radiating elements, a separation distance between the radiating elements, an elevation angle of the radiation beam to be emitted from the antenna system, and an azimuth angle of the radiation beam to be omitted from the antenna system for use by the computer in calculating the Q matrix.

37. The antenna system of claim 33, wherein the antenna system is a microstrip patch antenna or a monolithic microwave integrated circuit (MMIC) antenna array.

38. The antenna system of claim 33, wherein the array is planar or non-planar.

39. The antenna system of claim 33, wherein a spacing between the radiating elements in the array is regular.

40. The antenna system of claim 33, wherein a spacing between the radiating elements in the array is irregular.

41. The antenna system of claim 33, wherein the array of radiating elements has a top side and a bottom side; and wherein the device for feeding the differential-mode voltages or differential-mode currents to the radiating elements comprises:

at least one probe for feeding one of the radiating elements with one of the voltages or currents, wherein the one of the radiating elements has an aperture through which a top end of the at least one probe passes from the bottom side of the one of the radiating elements to the top side of the one of the radiating elements such that a top end of the probe extends above the aperture to generate the mutual coupling of the radiating elements from the top side of the radiating elements.

42. The antenna system of claim 41, wherein the probe comprises a center conductor of a coaxial cable.

43. The antenna system of claim 41, wherein the probe may be centered on the respective patches to exploit the mutual coupling among the radiating elements.

44. The antenna system of claim 41, wherein the array of radiating elements has a top side and a bottom side; and wherein the device for feeding the differential-mode voltages or differential-mode currents to the radiating elements comprises:

at least one probe for feeding one of the radiating elements with one of the voltages or currents, wherein the one of the radiating elements has an aperture through which a top end of the at least one probe passes from the bottom side of the one of the radiating elements to the top side of the one of the radiating elements such that a top end of the probe extends above the aperture and is looped over to contact the top side of the respective radiating element to generate the mutual coupling of the radiating elements from the top side of the radiating elements.

45. The antenna system of claim 33, wherein at least some of the radiating elements in the array comprise one or more apertures; and wherein the differential-mode voltages or differential-mode currents are applied to the radiating elements to generate a radiation beam that utilizes and exploits mutual coupling among the radiating elements in the array, wherein the device feeds the voltages or currents from below the radiating elements and wherein the mutual coupling is generated by electromagnetic fields below the radiating elements extending through the one or more apertures in the radiating elements.

46. The antenna system of claim 33, wherein the array of radiating elements has a top side and a bottom side; and wherein the device for feeding the differential-mode voltages or differential-mode currents to the radiating elements comprises:

a plurality of probes for feeding at least some of the radiating elements with different voltages or currents, wherein a plurality of the radiating elements to which voltages or currents are fed each have an aperture through which a top end of one of the probes passes from the bottom side of the radiating elements to the top side of the radiating elements such that top ends of the probes extend above the apertures to generate the mutual coupling of the radiating elements from the top side of the radiating elements.

47. The antenna system of claim 33, wherein the array of radiating elements has a top side and a bottom side; and wherein the device for feeding the differential-mode voltages or differential-mode currents to the radiating elements comprises:

a plurality of probes for feeding at least some of the radiating elements with different voltages or currents, wherein a plurality of the radiating elements to which voltages or currents are fed each have an aperture through which a top end of one of the probes passes from the bottom side of the radiating elements to the top side of the radiating elements such that top ends of the probes extend above the apertures and are looped over to contact the top side of the respective radiating element to generate the mutual coupling of the radiating elements from the top side of the radiating elements.

48. A method for controlling differential-mode operation of an antenna system, the antenna system comprising:

an array of radiating elements;

a control system for generating differential-mode voltages or differential-mode currents for exciting the radiating elements; and a device for feeding the differential-mode voltages or differential-mode currents to the radiating elements, the method comprising the steps of (a) calculating a matrix of complex numbers that is dependent on a direction of observation of radiation intensity emitted by the antenna system and on a geometry of the array of radiating elements, but is independent of voltage or current excitations of the array, wherein the matrix describes radiation in a far field and reflects mutual coupling effects of each radiating element in the array among all of the other radiating elements in the array, (b) calculating a radiation intensity in the direction of observation using the calculated matrix, and actual voltages or currents fed at each of the radiating elements in the array; and (c) applying the differential-mode voltages or differential-mode currents to the radiating elements to generate a radiation beam that exploits mutual coupling among the radiating elements in the array.

49. A method for controlling differential-mode operation of an antenna system, the antenna system comprising:

an array of radiating elements;

a control system for generating differential-mode voltages or differential-mode currents for exciting the radiating elements; and a device for feeding the differential-mode voltages or differential-mode currents to the radiating elements, the method comprising the steps of (a) calculating a matrix of complex numbers that is dependent on a direction of observation of radiation intensity emitted by the antenna system and on a geometry of the array of radiating elements, but is independent of voltage or current excitations of the array, (b) calculating a radiation intensity in the direction of observation using the calculated matrix, and actual voltages or currents fed at each of the radiating elements in the array; and (c) applying the differential-mode voltages or differential-mode currents to the radiating elements to generate a radiation beam that exploits mutual coupling among the radiating elements in the array, wherein the radiation intensity $dP/d\Omega$ is proportional to the following expression:

$$f=c\cdot QQ'\cdot c'/c\cdot c'$$

where c is a vector representable by a 1×M matrix of either currents or voltages to be applied to each of the radiating elements of the array of which there are M radiating elements, c' is the Hermitian conjugate of the c vector, Q is the matrix of complex numbers, and Q' is the Hermitian conjugate of the Q matrix.

50. A method for controlling differential-mode operation of an antenna system, the antenna system comprising:

an array of radiating elements;

a control system for generating differential-mode voltages or differential-mode currents for exciting the radiating elements; and a device for feeding the differential-mode voltages or differential-mode currents to the radiating elements, the method comprising the steps of (a) calculating a first matrix of complex numbers that is dependent on a direction of observation of radiation intensity emitted by the antenna system and on a geometry of the array of radiating elements, but is independent of voltage or current excitations of the array, (b) multiplying the first matrix by its Hermitian conjugate matrix to obtain a second matrix;

(c) determining eigenvalues and eigenvectors of the second matrix, and (d) selecting the voltages or currents to be fed to each of the radiating elements in the array based on one of the eigenvectors to achieve an optimal radiation intensity in the direction of observation; and (e) applying the selected differential-mode voltages or differential-mode currents to the radiating elements to generate a radiation beam that exploits mutual coupling among the radiating elements in the array.

51. The method of claim 50, wherein the voltages or currents are selected to achieve the optimal radiation intensity by selecting the voltages or currents to be the row eigenvector of the second matrix that corresponds to the largest eigenvalue of the second matrix.

52. The method of claim 50, further comprising calculating the radiation intensity $dP/d\Omega$ proportional to the following expression:

$$f=c\cdot QQ'\cdot c'/c\cdot c'$$

where c is a vector representable by a 1×M matrix of either currents or voltages to be applied to each of the radiating elements of the array of which there are M radiating elements, c' is the Hermitian conjugate of the c vector, Q is the matrix of complex numbers, and Q' is the Hermitian conjugate of the Q matrix.

53. A method for controlling differential-mode operation of an antenna system, the antenna system comprising:

an array of radiating elements;

a control system for generating differential-mode voltages or differential-mode currents for exciting the radiating elements; and a device for feeding the differential-mode voltages or differential-mode currents to the radiating elements, the method comprising the steps of (a) calculating a first matrix Q of complex numbers that is dependent on a direction of observation of radiation intensity emitted by the antenna system and on a geometry of the array of radiating elements, but is independent of voltage or current excitations of the array, (b) multiplying the first matrix Q by its Hermitian conjugate matrix Q' to obtain a second matrix QQ';

(c) calculating a gain matrix G by averaging the second matrix over all solid angles, (d) determining an optimal generalized eigenvalue and eigenvector obtained from a ratio of $c \cdot QQ' \cdot c'/c \cdot G \cdot c'$, wherein c represents a matrix of voltages or currents to be applied to the radiating elements, c' represents the Hermitian conjugate of the c matrix;

(e) determining an optimal gain which corresponds to the optimal generalized eigenvalue and determining the voltages or currents to be fed to each of the radiating elements in the array from the corresponding generalized eigenvector to achieve an optimal gain function in the direction of observation, and (f) applying the differential-mode voltages or differential-mode currents to the radiating elements to generate a radiation beam that exploits mutual coupling among the radiating elements in the array.

54. The method of claim 53, further comprising calculating the radiation intensity dP/dΩ proportional to the following expression:

$$f = c \cdot QQ' \cdot c'/c \cdot c'$$

wherein c is a vector representable by a 1×M matrix of either currents or voltages to be applied to each of the radiating elements of the array of which there are M radiating elements.

55. A computer-readable medium having stored thereon a program for use in calculating a radiation intensity of an array of radiating elements in an antenna system and differential-mode voltages or differential-mode currents to be fed to the radiating elements to exploit mutual coupling among the radiating elements, wherein the program, when executed by the computer, performs the steps of:

(i) calculating a matrix of complex numbers that is dependent on a direction of observation of radiation intensity emitted by the antenna system and on a geometry of the array of radiating elements, but is independent of voltage or current excitations of the array, wherein the matrix describes radiation in a far field and reflects mutual coupling effects of each radiating element in the array among all of the other radiating elements in the array, and (ii) calculating a radiation intensity in the direction of observation using the calculated matrix, and actual voltages or currents to be fed at each of the radiating elements in the array.

56. A computer-readable medium having stored thereon a program for use in calculating a radiation intensity of an array of radiating elements in an antenna system and differential-mode voltages or differential-mode currents to be fed to the radiating elements to exploit mutual coupling among the radiating elements, wherein the program, when executed by the computer, performs the steps of:

(i) calculating a matrix of complex numbers that is dependent on a direction of observation of radiation intensity emitted by the antenna system and on a geometry of the array of radiating elements, but is independent of voltage or current excitations of the array, (ii) calculating a radiation intensity in the direction of observation using the calculated matrix, and actual voltages or currents to be fed at each of the radiating elements in the array, wherein the radiation intensity dP/dΩ is proportional to the following expression:

$$f = c \cdot QQ' \cdot c'/c \cdot c'$$

where c is a vector representable by a 1×M matrix of either currents or voltages to be applied to each of the radiating elements of the array of which there are M radiating elements, c' is the Hermitian conjugate of the c vector, Q is the matrix of complex numbers, and Q' is the Hermitian conjugate of the Q matrix.

57. The computer of claim 56, wherein the Q matrix is an M×2 matrix where M is the number of the radiating elements in the array.

58. A computer-readable medium having stored thereon a program for use in calculating a radiation intensity of an array of radiating elements in an antenna system and differential-mode voltages or differential-mode currents to be fed to the radiating elements to exploit mutual coupling among the radiating elements, wherein the program, when executed by the computer, performs the steps of:

(i) calculating a first matrix of complex numbers that is dependent on a direction of observation of radiation intensity emitted by the antenna system and on a geometry of the array of radiating elements, but is independent of voltage or current excitations of the array, (ii) multiplying the first matrix by its Hermitian conjugate matrix to obtain a second matrix;

(iii) determining eigenvalues and eigenvectors of the second matrix, and (iv) selecting the voltages or currents to be fed to each of the radiating elements in the array based on one of the eigenvectors to achieve an optimal radiation intensity in the direction of observation.

59. A computer-readable medium having stored thereon a program for use in calculating a radiation intensity of an array of radiating elements in an antenna system and differential-mode voltages or differential-mode currents to be fed to the radiating elements to exploit mutual coupling among the radiating elements, wherein the program, when executed by the computer, performs the steps of:

(i) calculating a first matrix Q of complex numbers that is dependent on a direction of observation of radiation intensity emitted by the antenna system and on a geometry of the array of radiating elements, but is independent of voltage or current excitations of the array, (ii) multiplying the first matrix by its Hermitian conjugate matrix Q' to obtain a second matrix QQ';

(iii) calculating a gain matrix G by averaging the second matrix over all solid angles;

(iv) determining an optimal generalized eigenvalue and eigenvector obtained from a ratio of $c \cdot QQ' \cdot c'/c \cdot G \cdot c'$, wherein c represents a matrix of voltages or currents to be applied to the radiating elements, c' represents the Hermitian conjugate of the c matrix; and (v) determining an optimal gain which corresponds to the optimal generalized eigenvalue and determining the voltages or currents to be fed to each of the radiating elements in the array from the corresponding generalized eigenvector to achieve an optimal gain function in the direction of observation.

* * * * *